US006882258B2

(12) United States Patent
Castonguay et al.

(10) Patent No.: US 6,882,258 B2
(45) Date of Patent: Apr. 19, 2005

(54) MECHANICAL BELL ALARM ASSEMBLY FOR A CIRCUIT BREAKER

(75) Inventors: Roger Neil Castonguay, Terryville, CT (US); Dean Arthur Robarge, Southington, CT (US); Girish Mruthunjaya Hassan, Seconderabad (IN)

(73) Assignee: General Electric Company, Schenectady, NY (US)

( * ) Notice: Subject to any disclaimer, the term of this patent is extended or adjusted under 35 U.S.C. 154(b) by 651 days.

(21) Appl. No.: 09/795,017

(22) Filed: Feb. 27, 2001

(65) Prior Publication Data

US 2004/0090293 A1 May 13, 2004

(51) Int. Cl.[7] ..... H01H 67/02

(52) U.S. Cl. ..... 335/132; 335/202

(58) Field of Search ..... 335/6, 16, 147, 335/195, 132, 202, 23–25, 165–176; 218/22; 200/293–308

(56) References Cited

U.S. PATENT DOCUMENTS

| | | | |
|---|---|---|---|
| 2,340,682 | A | 2/1944 | Powell |
| 2,719,203 | A | 9/1955 | Gelzheiser et al. |
| 2,937,254 | A | 5/1960 | Ericson |
| 3,158,717 | A | 11/1964 | Jencks et al. |
| 3,162,739 | A | 12/1964 | Klein et al. |
| 3,197,582 | A | 7/1965 | Norden |
| 3,307,002 | A | 2/1967 | Cooper |
| 3,517,356 | A | 6/1970 | Hanafusa |
| 3,631,369 | A | 12/1971 | Menocal |
| 3,803,455 | A | 4/1974 | Willard |
| 3,883,781 | A | 5/1975 | Cotton |
| 4,129,762 | A | 12/1978 | Bruchet |
| 4,144,513 | A | 3/1979 | Shaffer et al. |
| 4,158,119 | A | 6/1979 | Krakik |
| 4,165,453 | A | 8/1979 | Hennemann |
| 4,166,988 | A | 9/1979 | Ciarcia et al. |
| 4,166,989 | A | 9/1979 | Castonguay et al. |
| 4,220,934 | A | 9/1980 | Wafer et al. |
| 4,255,732 | A | 3/1981 | Wafer et al. |
| 4,259,651 | A | 3/1981 | Yamat |
| 4,263,492 | A | 4/1981 | Maier et al. |
| 4,276,527 | A | 6/1981 | Gerbert-Gaillard et al. |
| 4,297,663 | A | 10/1981 | Seymour et al. |
| 4,301,342 | A | 11/1981 | Castonguay et al. |
| 4,360,852 | A | 11/1982 | Gilmore |
| 4,368,444 | A | 1/1983 | Preuss et al. |
| 4,375,021 | A | 2/1983 | Pardini et al. |
| 4,375,022 | A | 2/1983 | Daussin et al. |

(Continued)

FOREIGN PATENT DOCUMENTS

| | | |
|---|---|---|
| BE | 819 008 A | 12/1974 |
| DE | 12 27 978 | 11/1966 |
| DE | 30 47 360 | 6/1982 |

(Continued)

*Primary Examiner*—Lincoln Donovan
(74) *Attorney, Agent, or Firm*—Cantor Colburn LLP

(57) ABSTRACT

An assembly for interacting with a circuit breaker operating mechanism of a circuit breaker, the assembly including an accessory device, an actuator, and a compliant device. The accessory device includes a plunger configured for movement between a retracted position and a protruded position. The actuator includes a first free end and a second free end, the second free end configured for mechanical cooperation with the plunger. The compliant device is disposed intermediate the operating mechanism and the actuator, the compliant device is configured for mechanical cooperation with the second free end of the actuator. A force is applied from the operating mechanism to the accessory device, the force for resetting the accessory device is transmitted from the operating mechanism to the compliant device, from the compliant device to the actuator, and from the actuator to the plunger for resetting the plunger from the protruded position to the retracted position.

18 Claims, 22 Drawing Sheets

U.S. PATENT DOCUMENTS 4,376,270 A 3/1983 Staffen
4,383,146 A 5/1983 Bur
4,392,036 A 7/1983 Troebel et al.
4,393,283 A 7/1983 Masuda
4,401,872 A 8/1983 Boichot-Castagne et al.
4,409,573 A 10/1983 Di Marco et al.
4,435,690 A 3/1984 Link et al.
4,467,297 A 8/1984 Boichot-Castagne et al.
4,468,645 A 8/1984 Gerbert-Gaillard et al.
4,470,027 A 9/1984 Link et al.
4,479,143 A 10/1984 Watanabe et al.
4,488,133 A 12/1984 McClellan et al.
4,492,941 A 1/1985 Nagel
4,541,032 A 9/1985 Schwab
4,546,224 A 10/1985 Mostosi
4,550,360 A 10/1985 Dougherty
4,562,419 A 12/1985 Preuss et al.
4,589,052 A 5/1986 Dougherty
4,595,812 A 6/1986 Tamaru et al.
4,611,187 A 9/1986 Banfi
4,612,430 A 9/1986 Sloan et al.
4,616,198 A 10/1986 Pardini
4,622,444 A 11/1986 Kandatsu et al.
4,631,625 A 12/1986 Alexander et al.
4,642,431 A 2/1987 Tedesco et al.
4,644,438 A 2/1987 Puccinelli et al.
4,649,247 A 3/1987 Preuss et al.
4,658,322 A 4/1987 Rivera
4,672,501 A 6/1987 Bilac et al.
4,675,481 A 6/1987 Markowski et al.
4,682,264 A 7/1987 Demeyer
4,689,712 A 8/1987 Demeyer
4,694,373 A 9/1987 Demeyer
4,710,845 A 12/1987 Demeyer
4,717,985 A 1/1988 Demeyer
4,733,211 A 3/1988 Castonguay et al.
4,733,321 A 3/1988 Lindeperg
4,764,650 A 8/1988 Bur et al.
4,768,007 A 8/1988 Mertz et al.
4,780,786 A 10/1988 Weynachter et al.
4,831,221 A 5/1989 Yu et al.
4,870,531 A 9/1989 Danek
4,883,931 A 11/1989 Batteux et al.
4,884,047 A 11/1989 Baginski et al.
4,884,164 A 11/1989 Dziura et al.
4,900,882 A 2/1990 Bernard et al.
4,910,485 A 3/1990 Bolongeat-Mobleu et al.
4,914,541 A 4/1990 Tripodi et al.
4,916,420 A 4/1990 Bartolo et al.
4,916,421 A 4/1990 Pardini et al.
4,926,282 A 5/1990 McGhie
4,935,590 A 6/1990 Malkin et al.
4,937,706 A 6/1990 Schueller et al.
4,939,492 A 7/1990 Raso et al.
4,943,691 A 7/1990 Mertz et al.
4,943,888 A 7/1990 Jacob et al.
4,950,855 A 8/1990 Bolongeat-Mobleu et al.
4,951,019 A 8/1990 Gula
4,952,897 A 8/1990 Barnel et al.
4,958,135 A 9/1990 Baginski et al.
4,965,543 A 10/1990 Batteux
4,983,788 A 1/1991 Pardini
5,001,313 A 3/1991 Leclercq et al.
5,004,878 A 4/1991 Seymour et al.
5,029,301 A 7/1991 Nebon et al.
5,030,804 A 7/1991 Abri
5,036,303 A 7/1991 Papallo, Jr. et al.
5,057,655 A 10/1991 Kersusan et al.
5,077,627 A 12/1991 Fraisse
5,083,081 A 1/1992 Barrault et al.
5,093,643 A * 3/1992 Altenhof et al. ..... 335/20
5,095,183 A 3/1992 Raphard et al.
5,103,198 A 4/1992 Morel et al.
5,115,371 A 5/1992 Tripodi
5,120,921 A 6/1992 DiMarco et al.
5,132,865 A 7/1992 Mertz et al.
5,138,121 A 8/1992 Streich et al.
5,140,115 A 8/1992 Morris
5,153,802 A 10/1992 Mertz et al.
5,155,315 A 10/1992 Malkin et al.
5,166,483 A 11/1992 Kersusan et al.
5,172,087 A 12/1992 Castonguay et al.
5,178,504 A 1/1993 Falchi
5,184,717 A 2/1993 Chou et al.
5,187,339 A 2/1993 Lissandrin
5,198,956 A 3/1993 Dvorak
5,200,724 A 4/1993 Gula et al.
5,210,385 A 5/1993 Morel et al.
5,239,150 A 8/1993 Bolongeat-Mobleu et al.
5,260,533 A 11/1993 Livesey et al.
5,262,744 A 11/1993 Arnold et al.
5,280,144 A 1/1994 Bolongeat-Mobleu et al.
5,281,776 A 1/1994 Morel et al.
5,296,660 A 3/1994 Morel et al.
5,296,664 A 3/1994 Crookston et al.
5,298,874 A 3/1994 Morel et al.
5,300,907 A 4/1994 Nereau et al.
5,310,971 A 5/1994 Vial et al.
5,313,180 A 5/1994 Vial et al.
5,317,471 A 5/1994 Izoard et al.
5,331,500 A 7/1994 Corcoles et al.
5,334,808 A 8/1994 Bur et al.
5,341,191 A 8/1994 Crookston et al.
5,347,096 A 9/1994 Bolongeat-Mobleu et al.
5,347,097 A 9/1994 Bolongeat-Mobleu et al.
5,350,892 A 9/1994 Rozier
5,357,066 A 10/1994 Morel et al.
5,357,068 A 10/1994 Rozier
5,357,394 A 10/1994 Piney
5,361,052 A 11/1994 Ferullo et al.
5,373,130 A 12/1994 Barrault et al.
5,379,013 A 1/1995 Coudert
5,424,701 A 6/1995 Castonguay et al.
5,438,176 A 8/1995 Bonnardel et al.
5,440,088 A 8/1995 Coudert et al.
5,449,871 A 9/1995 Batteux et al.
5,450,048 A 9/1995 Leger et al.
5,451,729 A 9/1995 Onderka et al.
5,457,295 A 10/1995 Tanibe et al.
5,467,069 A 11/1995 Payet-Burin et al.
5,469,121 A 11/1995 Payet-Burin
5,475,558 A 12/1995 Barjonnet et al.
5,477,016 A 12/1995 Baginski et al.
5,479,143 A 12/1995 Payet-Burin
5,483,212 A 1/1996 Lankuttis et al.
5,485,343 A 1/1996 Santos et al.
D367,265 S 2/1996 Yamagata et al.
5,493,083 A 2/1996 Olivier
5,504,284 A 4/1996 Lazareth et al.
5,504,290 A 4/1996 Baginski et al.
5,510,761 A 4/1996 Boder et al.
5,512,720 A 4/1996 Coudert et al.
5,515,018 A 5/1996 DiMarco et al.
5,519,561 A 5/1996 Mrenna et al.
5,534,674 A 7/1996 Steffens
5,534,832 A 7/1996 Duchemin et al.
5,534,835 A 7/1996 McColloch et al.
5,534,840 A 7/1996 Cuingnet
5,539,168 A 7/1996 Linzenich
5,543,595 A 8/1996 Mader et al.
5,552,755 A 9/1996 Fello et al.

| | | | | |
|---|---|---|---|---|
| 5,581,219 | A | 12/1996 | Nozawa et al. | |
| 5,604,656 | A | 2/1997 | Derrick et al. | |
| 5,608,367 | A | 3/1997 | Zoller et al. | |
| 5,784,233 | A | 7/1998 | Bastard et al. | |
| 5,923,261 | A | 7/1999 | Castonguay et al. | |
| 6,087,913 | A | 7/2000 | Castonguay et al. | |
| 6,114,641 | A | 9/2000 | Castonguay et al. | |
| 6,175,288 | B1 | 1/2001 | Castonguay et al. | |
| 6,600,396 | B1 * | 7/2003 | Rodriguez et al. | 335/132 |

FOREIGN PATENT DOCUMENTS

| | | |
|---|---|---|
| DE | 38 02 184 | 8/1989 |
| DE | 38 43 277 | 6/1990 |
| DE | 44 19 240 | 1/1995 |
| EP | 0 061 092 | 9/1982 |
| EP | 0 064 906 | 11/1982 |
| EP | 0 066 486 | 12/1982 |
| EP | 0 076 719 | 4/1983 |
| EP | 0 117 094 | 8/1984 |
| EP | 0 140 761 | 5/1985 |
| EP | 0 174 904 | 3/1986 |
| EP | 0 196 241 | 10/1986 |
| EP | 0 224 396 | 6/1987 |
| EP | 0 235 479 | 9/1987 |
| EP | 0 239 460 | 9/1987 |
| EP | 0 258 090 | 3/1988 |
| EP | 0 264 313 | 4/1988 |
| EP | 0 264 314 | 4/1988 |
| EP | 0 283 189 | 9/1988 |
| EP | 0 283 358 | 9/1988 |
| EP | 0 291 374 | 11/1988 |
| EP | 0 295 155 | 12/1988 |
| EP | 0 295 158 | 12/1988 |
| EP | 0 309 923 | 4/1989 |
| EP | 0 313 106 | 4/1989 |
| EP | 0 313 422 | 4/1989 |
| EP | 0 314 540 | 5/1989 |
| EP | 0 331 586 | 9/1989 |
| EP | 0 337 900 | 10/1989 |
| EP | 0 342 133 | 11/1989 |
| EP | 0 367 690 | 5/1990 |
| EP | 0 371 887 | 6/1990 |
| EP | 0 375 568 | 6/1990 |
| EP | 0 394 144 | 10/1990 |
| EP | 0 394 922 | 10/1990 |
| EP | 0 399 282 | 11/1990 |
| EP | 0 407 310 | 1/1991 |
| EP | 0 452 230 | 10/1991 |
| EP | 0 555 158 | 8/1993 |
| EP | 0 560 697 | 9/1993 |
| EP | 0 567 416 | 10/1993 |
| EP | 0 595 730 | 5/1994 |
| EP | 0 619 591 | 10/1994 |
| EP | 0 665 569 | 8/1995 |
| EP | 0 700 140 | 3/1996 |
| EP | 0 889 498 | 1/1999 |
| FR | 2 410 353 | 6/1979 |
| FR | 2 512 582 | 3/1983 |
| FR | 2 553 943 | 4/1985 |
| FR | 2 592 998 | 7/1987 |
| FR | 2 682 531 | 4/1993 |
| FR | 2 697 670 | 5/1994 |
| FR | 2 699 324 | 6/1994 |
| FR | 2 714 771 | 7/1995 |
| GB | 2 233 155 | 1/1991 |
| WO | 92/00598 | 1/1992 |
| WO | 92/05649 | 4/1992 |
| WO | 94/00901 | 1/1994 |

* cited by examiner

MECHANICAL BELL ALARM ASSEMBLY FOR A CIRCUIT BREAKER

BACKGROUND OF THE INVENTION

This invention relates to circuit breakers, and, more particularly to a circuit breaker bell alarm assembly.

It is generally well known in the art of circuit breakers to provide a reset mechanism to reset a tripping device such as an accessory shunt trip or under voltage device. During quiescent operation, (i.e. when the circuit breaker contacts are closed to allow the flow of electrical current) the operating handle of an operating mechanism is in the "ON" position. To stop the current flow manually, the handle may be shifted to the "OFF" position thereby opening the electrical contacts. Upon attainment of a pre-determined condition (trip event), such as ground fault or overload, the operating mechanism of the circuit breaker will release the forces of the mechanism operating springs and release the operating handle to a tripped position between the "ON" position and the "OFF" position. Before the circuit breaker may be turned "ON", the operating mechanism must be manually reset. This is accomplished by rotating the operating handle beyond the "OFF" position against the bias of the operating mechanism springs, thereby locking the operating mechanism in position.

The same mechanical forces used to direct the operating mechanism from the tripped position to the reset position are used to reset any attached accessories, such as an electronic trip actuator, a shunt trip actuator, auxiliary switch accessory, bell alarm or other type of accessory unit. However, as accessories are generally separate components mounted proximate to the operating mechanism, positional variations at the interface of the accessory and the circuit breaker operating mechanism are possible due to manufacturing tolerances. These positional variations can affect the resetting motion translated to the accessory or its components.

SUMMARY OF THE INVENTION

The above discussed and other drawbacks and deficiencies of the prior art are overcome or alleviated by an assembly for interacting with a circuit breaker operating mechanism of a circuit breaker including a housing and a pair of contacts within the housing, the operating mechanism arranged to separate the pair of contacts upon the occurrence of a trip event.

In an exemplary embodiment of the invention, an assembly for interacting with a circuit breaker operating mechanism of a circuit breaker, the assembly comprising an accessory device, an actuator, and a compliant device. The accessory device is disposed in the circuit breaker housing including a plunger configured for movement between a retracted position and a protruded position. The actuator having a first free end and a second free end, the second free end of the actuator configured for mechanical cooperation with the plunger. The compliant device disposed intermediate the operating mechanism and the actuator, the compliant device configured for mechanical cooperation with the second free end of the actuator. A force is applied from the operating mechanism to the accessory device, the force for resetting the accessory device by being transmitted from the operating mechanism to the compliant device, from the compliant device to the actuator, and from the actuator to the plunger for resetting the plunger from the protruded position to the retracted position.

BRIEF DESCRIPTION OF THE DRAWINGS

Referring now to the drawings wherein like elements are numbered alike in the several FIGURES.

IN THE DETAILED DESCRIPTION OF THE INVENTION

Figure 1:
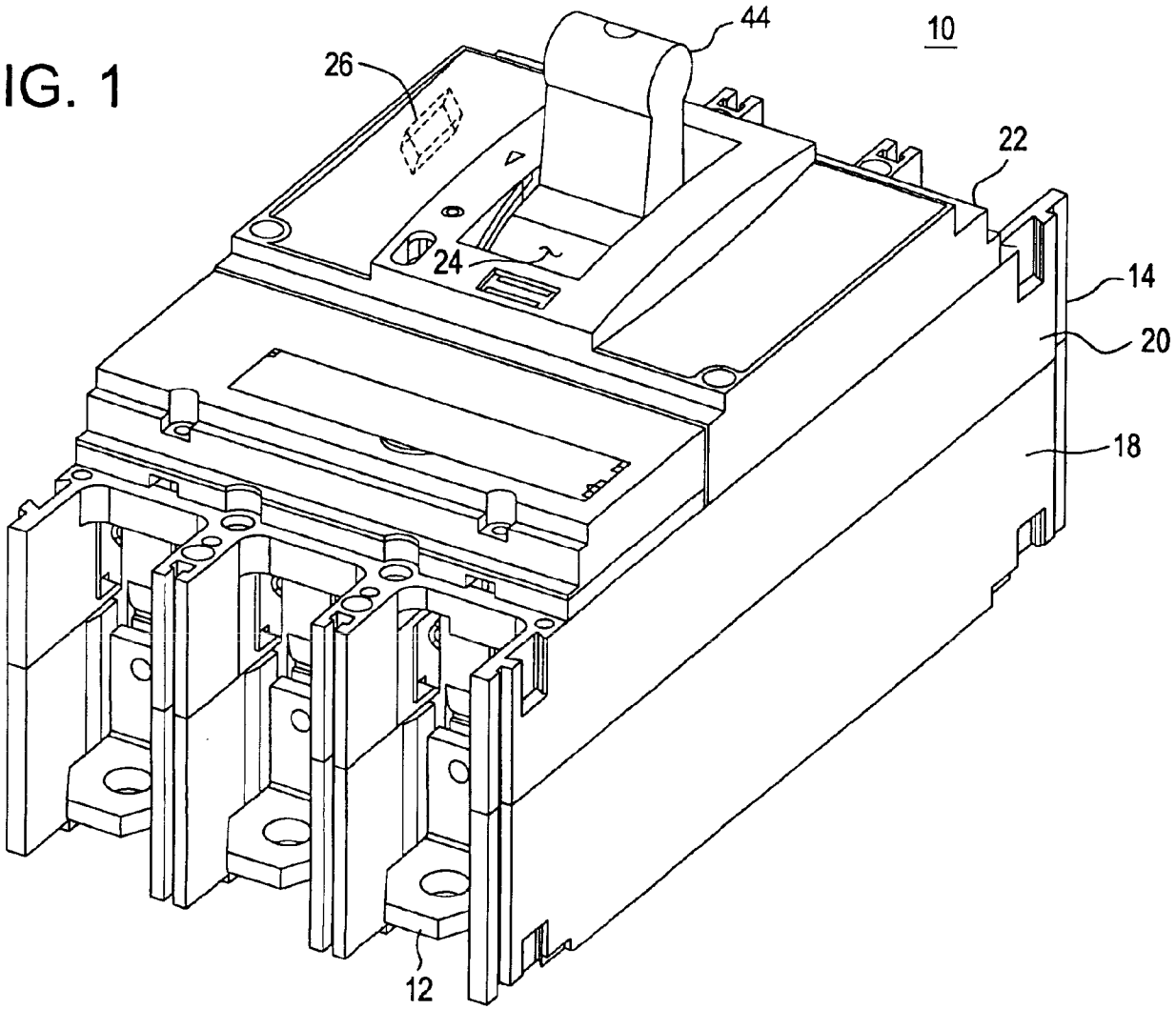
FIG. 1 is a top perspective view of a molded case circuit breaker.

Referring to FIG. 1, a top perspective view of a molded case circuit breaker 10 is generally shown. Molded case circuit breaker 10 is generally interconnected within a protected circuit between multiple phases of a power source (not shown) at line end 14 and a load to be protected (not shown) at load end 12. Molded case circuit breaker 10 includes a base 18, a mid cover 20 and a top cover 22 having a toggle handle (operating handle) extending through an opening 24. Toggle handle 44 is interconnected with a circuit breaker operating mechanism 38 (FIG. 2) and allows for external operation of cassettes 32, 34 and 36. An accessory (bell alarm switch) 26 is positioned within the mid cover 20 as shown in phantom, and interfaces with circuit breaker operating mechanism 38. In an exemplary embodiment, the accessory 26 is a bell alarm switch (switch).

Figure 2:
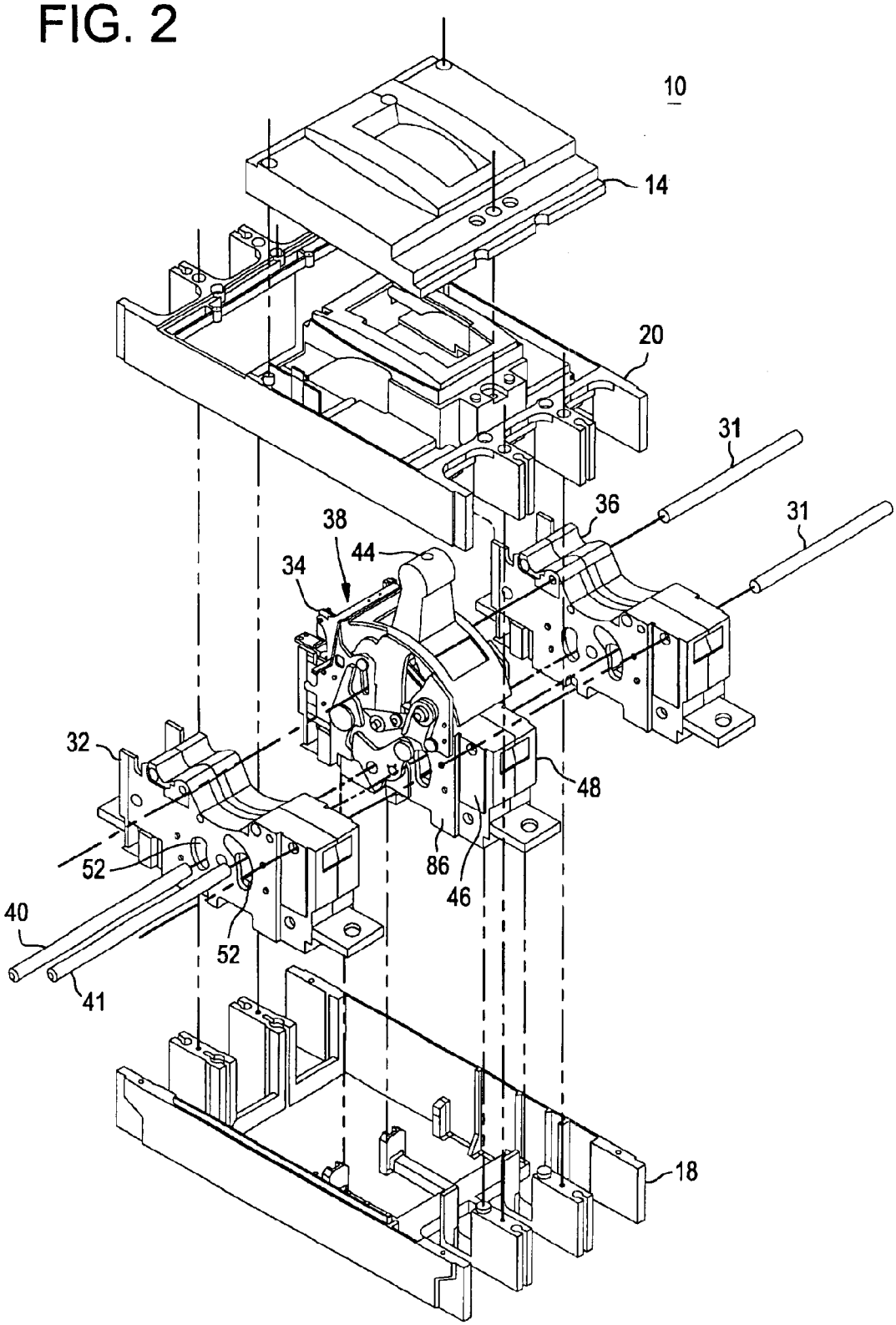
FIG. 2 is an exploded perspective view of a molded case circuit breaker.

Referring now to FIG. 2, an exploded view of molded case circuit breaker 10 is provided. A series of circuit breaker cassettes 32, 34, 36 are generally well known and may be, for example, of the rotary type. Examples of rotary contact structures that may be operated by operating mechanism 38 are described in more detail in U.S. patent application Ser. Nos. 09/087,038 and 09/384,908 both entitled "Rotary Contact Assembly For High-Ampere Rated Circuit Breakers", and U.S. patent application Ser. No. 09/384,495, entitled "Supplemental Trip Unit For Rotary Circuit Interrupters".

Circuit breaker cassettes 32, 34, 36 are seated approximately upstanding within base 18, and the cassette 34 includes operating mechanism 38 positioned thereon. The individual phases of current are divided into three phases, wherein each phase passes through one of the circuit breaker cassettes 32, 34, 36. Each of cassettes 32, 34, 36 includes one or more contact pairs therein for passage of current when the contacts are closed and for preventing passage of current when the contact pairs are opened. It is contemplated that the number of phases, or specific type of cassette utilized, can vary according to factors including, but not limited to, the type of load circuit being protected and the type of line input being provided to the circuit breaker 10.

Still referring to FIG. 2, each cassette 32, 34, 36 is commonly operated by a first cross bar (cross pin) 40 and a second cross bar 41 that interface with the internal mechanisms of cassettes 32, 34, 36 such that when one of cassettes 32, 34, 36 are opened or closed, the other cassettes 32, 34, 36 will operate cooperatively. Positioning rods 31 are also employed to position the cassettes 32, 34, 36 adjacent to each other. Operating mechanism 38 is positioned and configured atop cassette 34, which is generally disposed intermediate to cassettes 32 and 36. Operating mechanism 38 operates substantially as described herein and as described in U.S. patent application Ser. No. 09/196,706 entitled "Circuit Breaker Mechanism for a Rotary Contact Assembly". The cassettes 32, 34, 36 are typically formed of high strength plastic material and each include opposing sidewalls.

Figure 3:
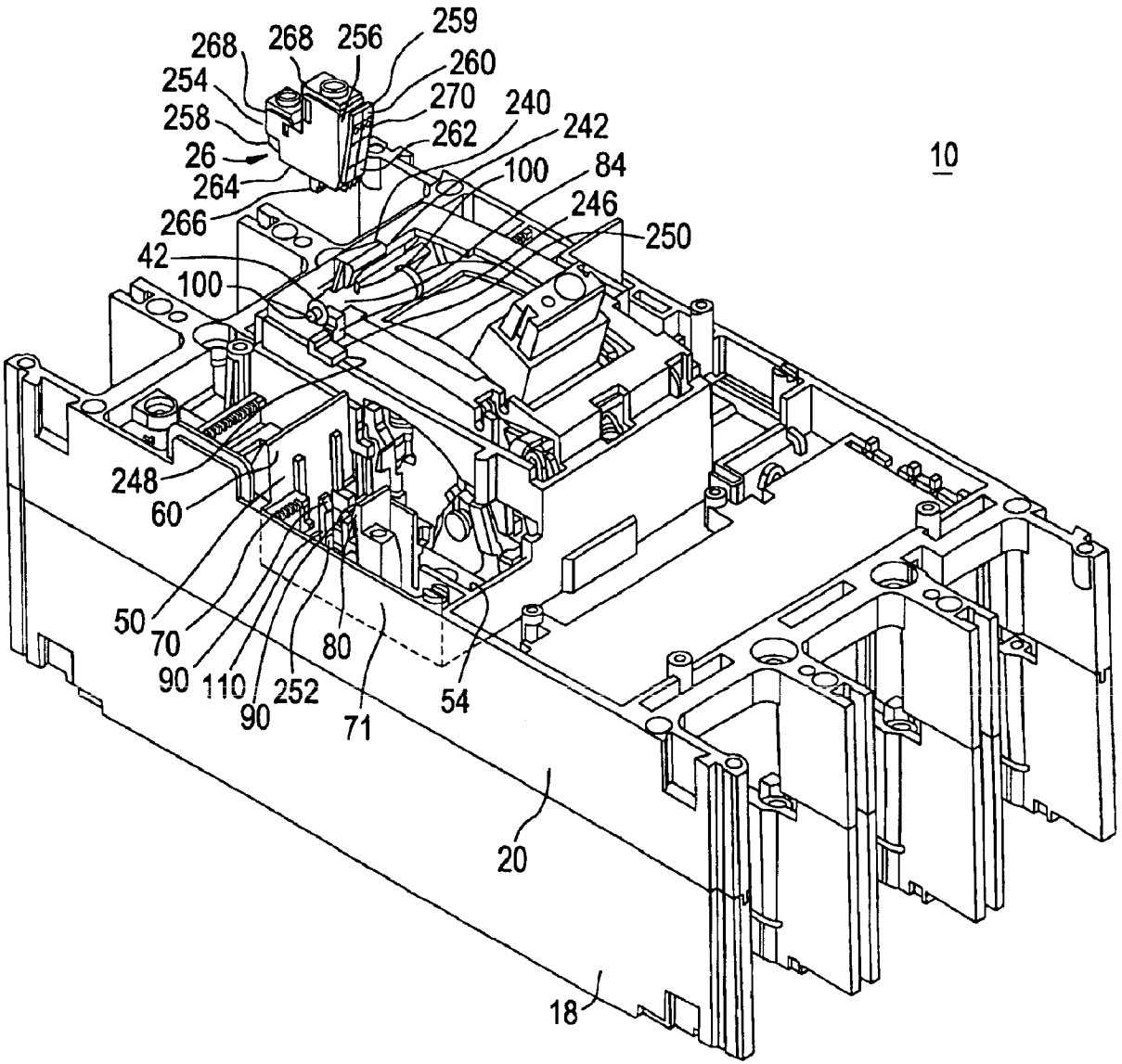
FIG. 3 is a side perspective view of the circuit breaker of FIG. 2 with the top cover removed and an actuator and a bell alarm switch in an assembly view.

Referring to FIG. 3, an isometric view of the circuit breaker 10 is shown, showing the bell alarm switch 26 and an actuator 42 in an exploded view with the top cover 22 (FIG. 1) removed. The switch 26 and the actuator 42 are shown removed from a cavity 50 located within the mid cover 20 for clarity.

The cavity 50 is formed integral with the mid cover 20 and comprises a front mounting surface 54, a rear mounting surface 60 and a bottom surface 70 (shown in phantom). The bottom surface 70 of the cavity 50 is perpendicular to the front and rear mounting surfaces 54, 60. Located within the rear mounting surface 60 is a shelf 71 and located within the front mounting surface 54 is a protrusion 80. The protrusion 80 and the shelf 71 are integrally molded within the cavity 50.

Before the switch 26 is mounted within the cavity 50, the actuator 42 is rotatably mounted within the cavity 50 after the mid cover 20 is installed over the base 18. The actuator 42 includes a main body portion 84, preferably cylindrical in shape. The main body portion 84 is secured in the cavity 50 using flexible locking tabs 90. The locking tabs 90 are molded within the mid cover 20 and project outward as shown in FIG. 3. The locking tabs 90 cannot be removed by the end user. The main body portion 84 includes extending tabs 100 that are rotatably mounted within corresponding recesses 110 located within the cavity 50 as shown by the dashed lines in FIG. 3. Extending outward from the main body portion 84 is a first leg 240 having a free end 242, preferably L-shaped, that extends toward the interior of the mid cover 20. Also extending outward from the main body portion 84 in an opposing direction to the first leg 240 is a second leg 246 having a free end 248, preferably having a finger 250 extending therefrom into an opening 252 located in the bottom surface 70 of cavity 50. The finger 250 is preferably planar and generally rectangular in shape.

The bell alarm switch 26 is mounted within cavity 50 located within the mid cover 20. The switch 26 comprises a front surface 254 and a rear surface 256 and a connecting bottom surface 264. The front surface 254 having a tab 258 disposed thereon. Extending upward from the rear surface 256 is a mounting prong 260. A first end 262 of the mounting prong 260 is attached to the switch 26 at a point just above the bottom surface 264. The mounting prong 260 is thin and flexible in comparison with the switch 26. The mounting prong 260 extends upward from the first end 262, it angles slightly away from the rear surface 256 of the switch 26. A second end 259 of the mounting prong 260 is separated a distance from the rear surface 256 of the switch 26.

The switch 26 also includes a push button plunger (plunger) 266 that is spring mounted from the bottom surface 264 of the switch 26. The plunger 266 is spring loaded to permit the plunger 266 to be depressed closing contacts within the switch 26 and also to be released back outward opening the contacts within the switch 26. When the switch 26 is installed within the cavity 50 as described hereinbelow, the plunger 266 extends downward and is positioned to align with the finger 250 of the actuator 42. The switch 26 may then be connected with a remote bell alarm, for example, by means of a pair of wires 268 that extend from the switch 26.

The bell alarm switch 26 is installed into the cavity 50 by the end user. When installing the switch 26 into the cavity 50, the tab 258 of the switch 26 is arranged so as to be inserted under the shelf 71. Then, the mounting prong 260 is flexed so that a tab 270 on the mounting prong 260 can snap into place under the protrusion 80. Thus, the switch 26 is held in position within the cavity 50 by the interaction of the tab 258 and the mounting prong 260 of the switch 26 with the shelf 71 and protrusion 80, respectively. When the switch 26 is installed in the mid cover 20 of the circuit breaker 10, the plunger 266 aligns with and is located proximate to the finger 250 of the actuator 42 as detailed hereinabove.

Figure 4:
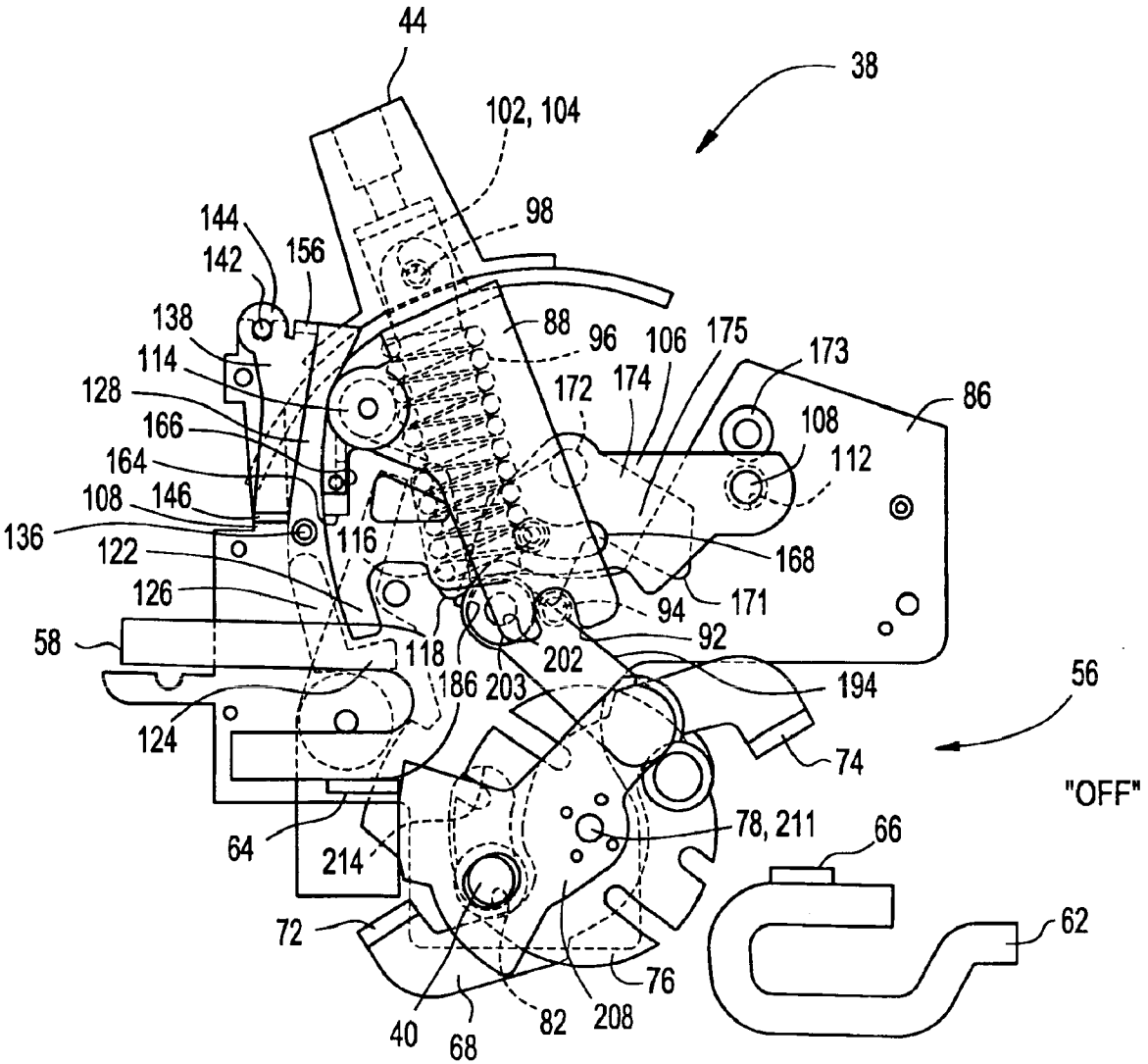
FIG. 4 is a partial sectional view of a rotary contact structure and operating mechanism embodied by the present invention in the "off" position.
Figure 5:
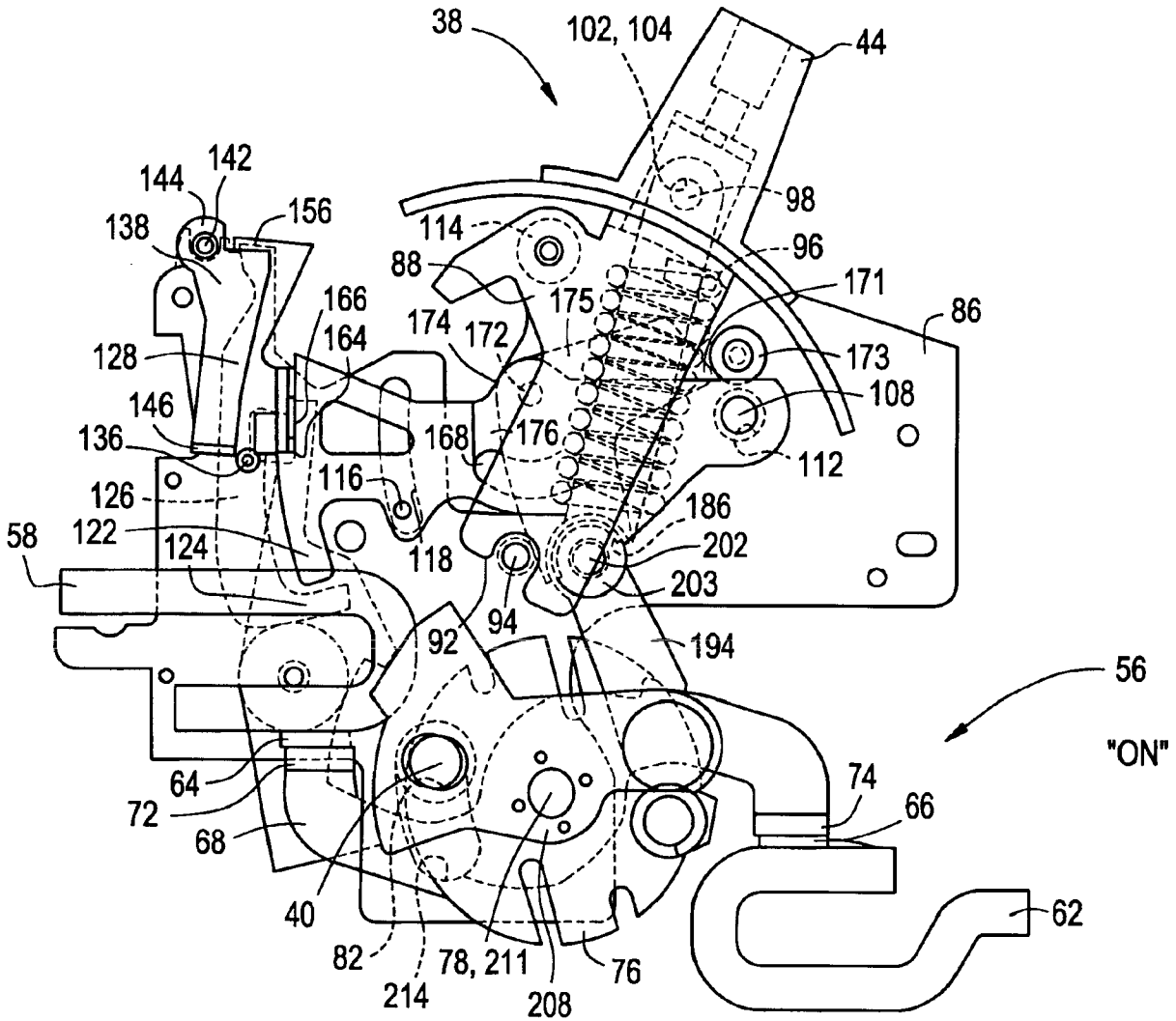
FIG. 5 is a partial sectional view of the rotary contact structure and operating mechanism of FIG. 3 in the "on" position.
Figure 6:
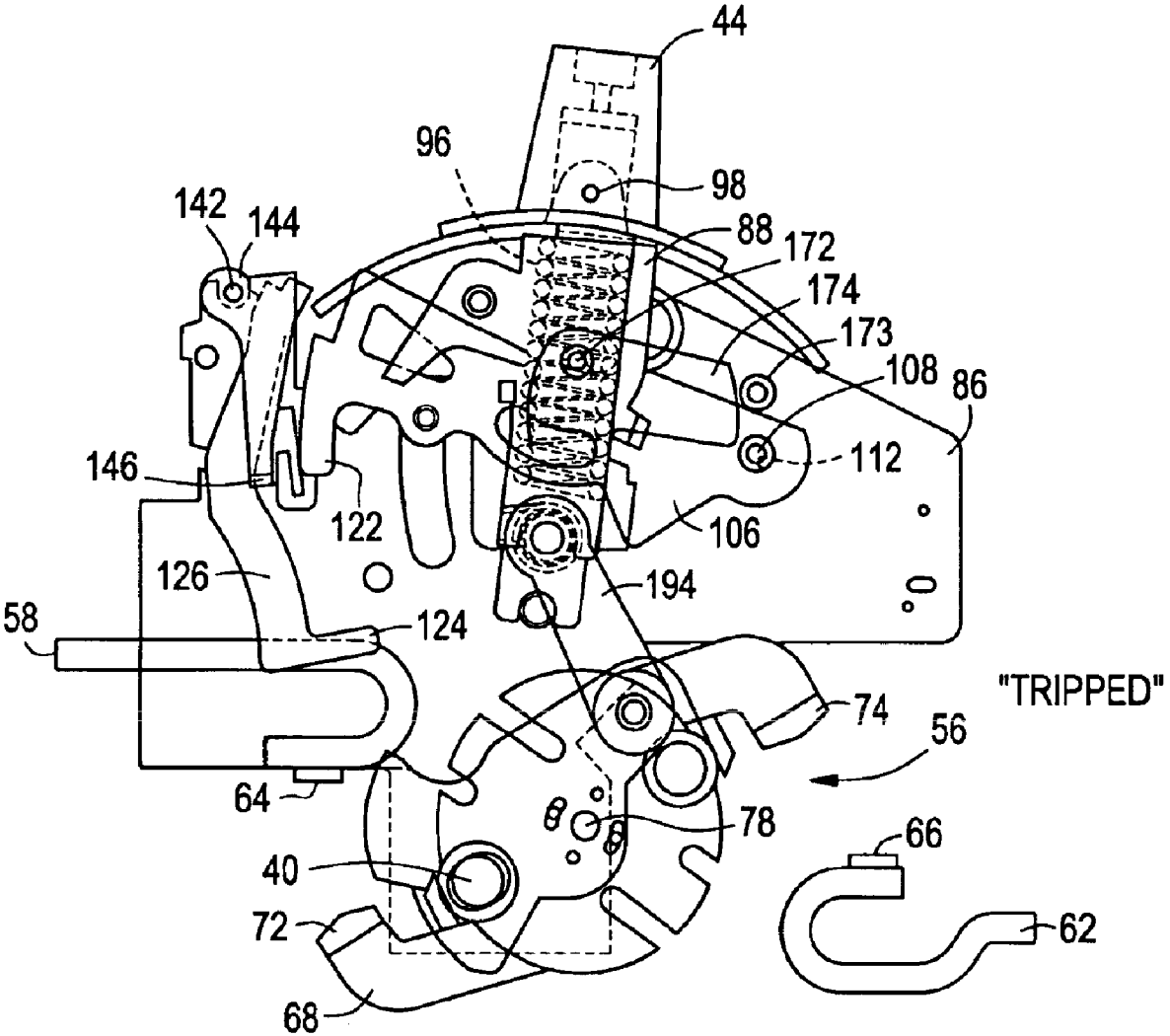
FIG. 6 is a partial sectional view of the rotary contact structure and operating mechanism of FIGS. 3 and 4 in the "tripped" position.

Referring now to FIGS. 4, 5, and 6, the operating mechanism 38 will now be detailed. An exemplary rotary contact assembly 56 is shown disposed within each cassette 32, 34, 36 is shown in the "off", "on" and "tripped" conditions, respectively. Also depicted are partial side views of operating mechanism 38, the components of which are described in greater detail further herein. Rotary contact assembly 56 includes a load side contact strap 58 and line side contact strap 62 for connection with a power source and a protected circuit (not shown), respectively. Load side contact strap 58 includes a stationary contact 64 and line side contact strap 62 includes a stationary contact 66. Rotary contact assembly 56 further includes a movable contact arm 68 having a set of contacts 72 and 74 that mate with stationary contacts 64 and 66, respectively. In the "off" position (FIG. 4) of operating mechanism 38, wherein toggle handle 44 is oriented to the left (e.g., via a manual or mechanical force), contacts 72 and 74 are separated from stationary contacts 64 and 66, thereby preventing current from flowing through contact arm 68.

In the "on" position (FIG. 5) of operating mechanism 38, wherein toggle handle 44 is oriented to the right as depicted in FIG. 4 (e.g., via a manual or mechanical force), contacts 72 and 74 are mated with stationary contacts 64 and 66, thereby allowing current to flow through contact arm 68. In the "tripped" position (FIG. 6) of operating mechanism 38, toggle handle 44 is oriented between the "on" position and the "off" position (typically by the release of mechanism springs within operating mechanism 38, described in greater detail herein). In this "tripped" position, contacts 72 and 74 are separated from stationary contacts 64 and 66 by the action of operating mechanism 38, thereby preventing current from flowing through contact arm 68. After operating mechanism 38 is in the "tripped" position, it must ultimately be returned to the "on" position for operation. This is effectuated by applying a reset force to move toggle handle 44 to a "reset" condition, which is beyond the "off" position (i.e., further to the left of the "off" position in FIG. 4), and then back to the "on" position. This reset force must be high enough to overcome the mechanism springs, described herein.

Contact arm 68 is mounted on a rotor structure 76 that houses one or more sets of contact springs (not shown). Contact arm 68 and rotor structure 76 pivot about a common center 78. Cross pin 40 interfaces through an opening 82 within rotor structure 76 generally to cause contact arm 68 to be moved from the "on", "off" and "tripped" position.

Figure 7:
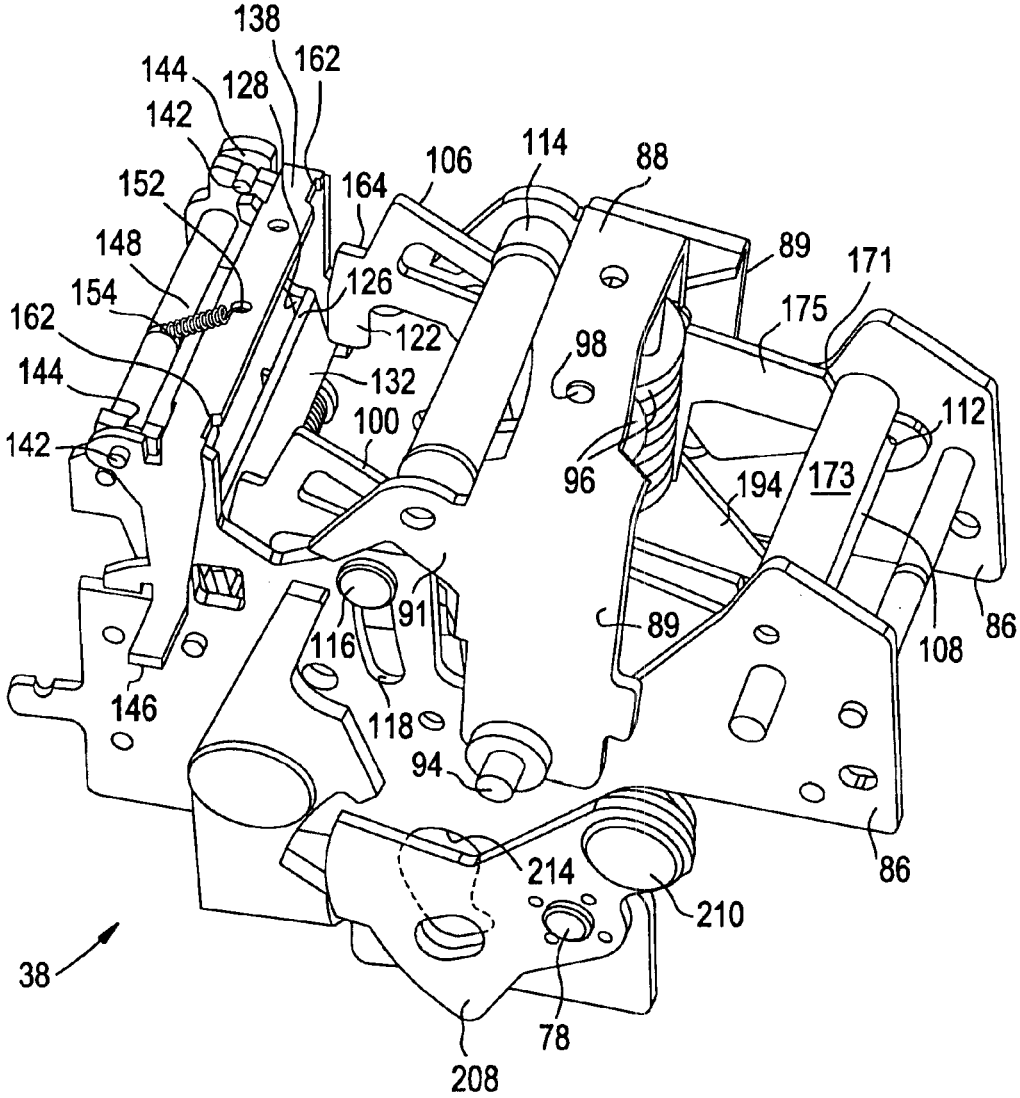
FIG. 7 is an isometric view of the operating mechanism.
Figure 8:
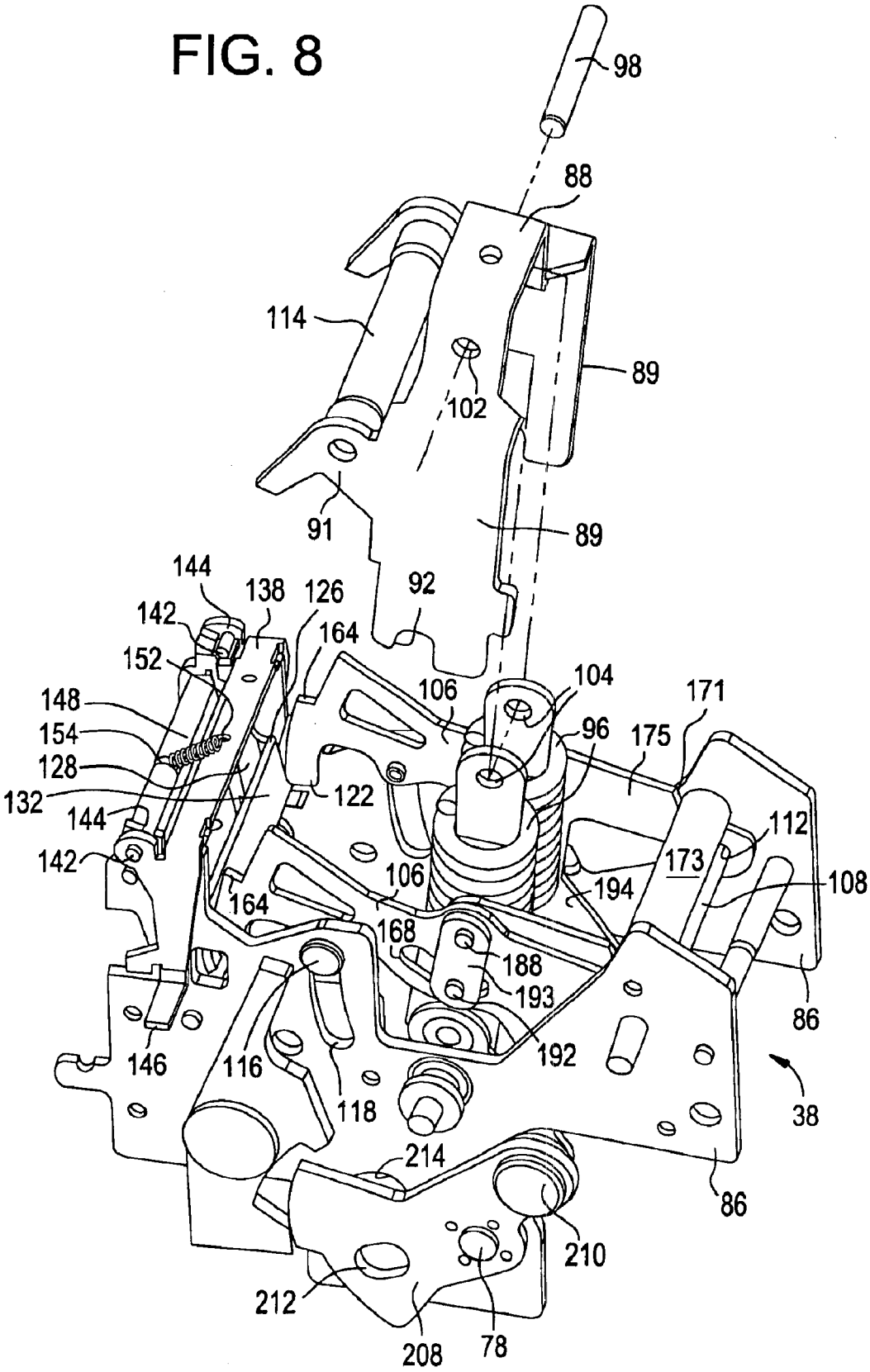
FIG. 8 is a partially exploded view of the operating mechanism.
Figure 9:
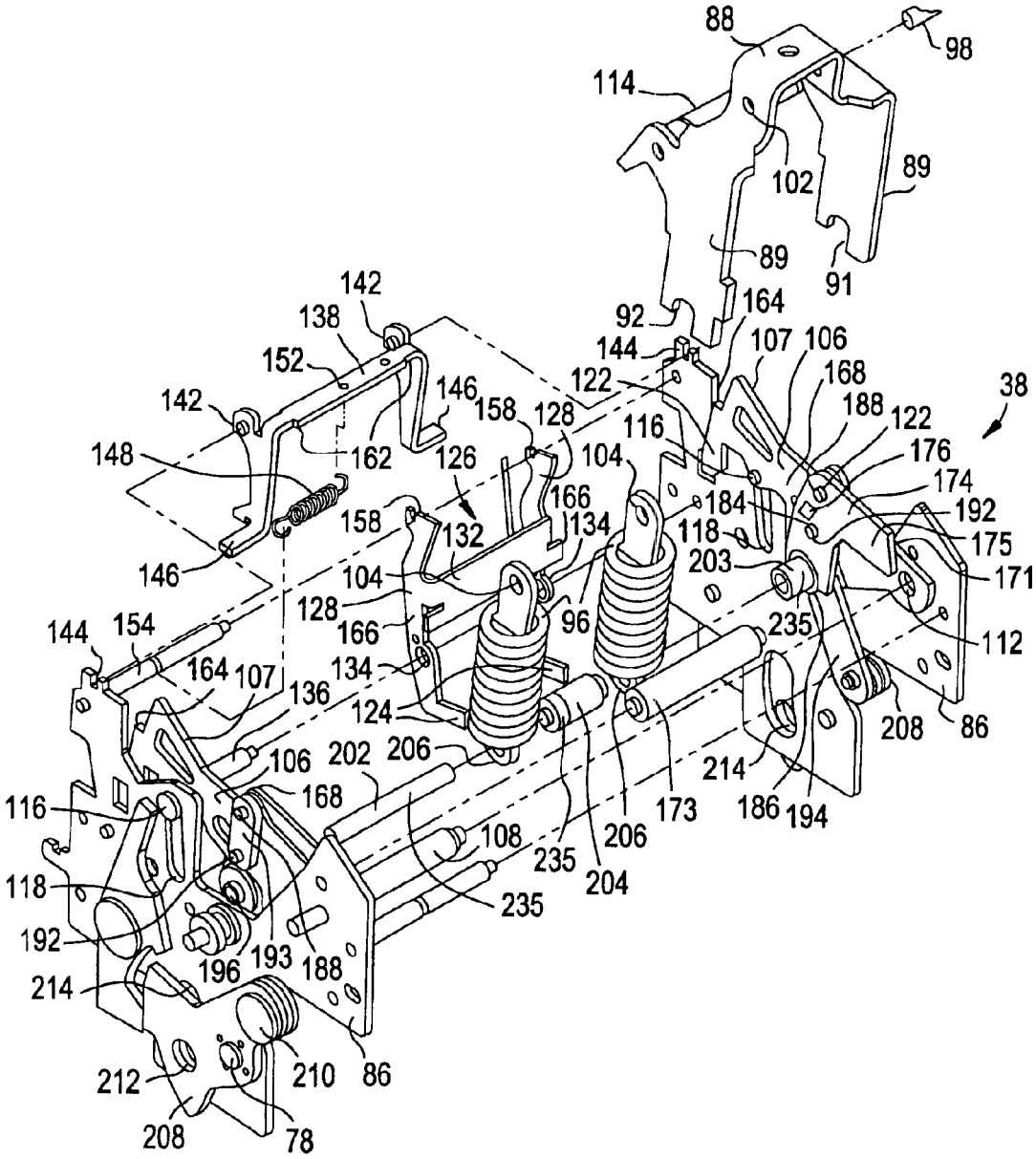
FIG. 9 is another partially exploded view of the operating mechanism.

Referring now to FIGS. 7–9, the components of operating mechanism 38 will now be detailed. As viewed in FIGS. 7–9, operating mechanism 38 is in the "tripped" position. Operating mechanism 38 has operating mechanism side frames 86 configured and positioned to straddle sidewalls 46, 48 of cassette 34 (FIG. 2).

Toggle handle 44 (FIG. 2) is rigidly interconnected with a drive member or handle yoke 88. Handle yoke 88 includes opposing side portions 89. Each side portion 89 includes an extension 91 at the top of side portion 89, and a U-shaped portion 92 at the bottom portion of each side portion 89. U-shaped portions 92 are rotatably positioned on a pair of bearing portions 94 protruding outwardly from side frames 86. Bearing portions 94 are configured to retain handle yoke 88, for example, with a securement washer. Handle yoke 88 further includes a roller pin 114 extending between extensions 91.

Handle yoke 88 is connected to a set of powerful mechanism springs 96 by a spring anchor 98, which is generally supported within a pair of openings 102 in handle yoke 88 and arranged through a complementary set of openings 104 on the top portion of mechanism springs 96.

Figure 10:
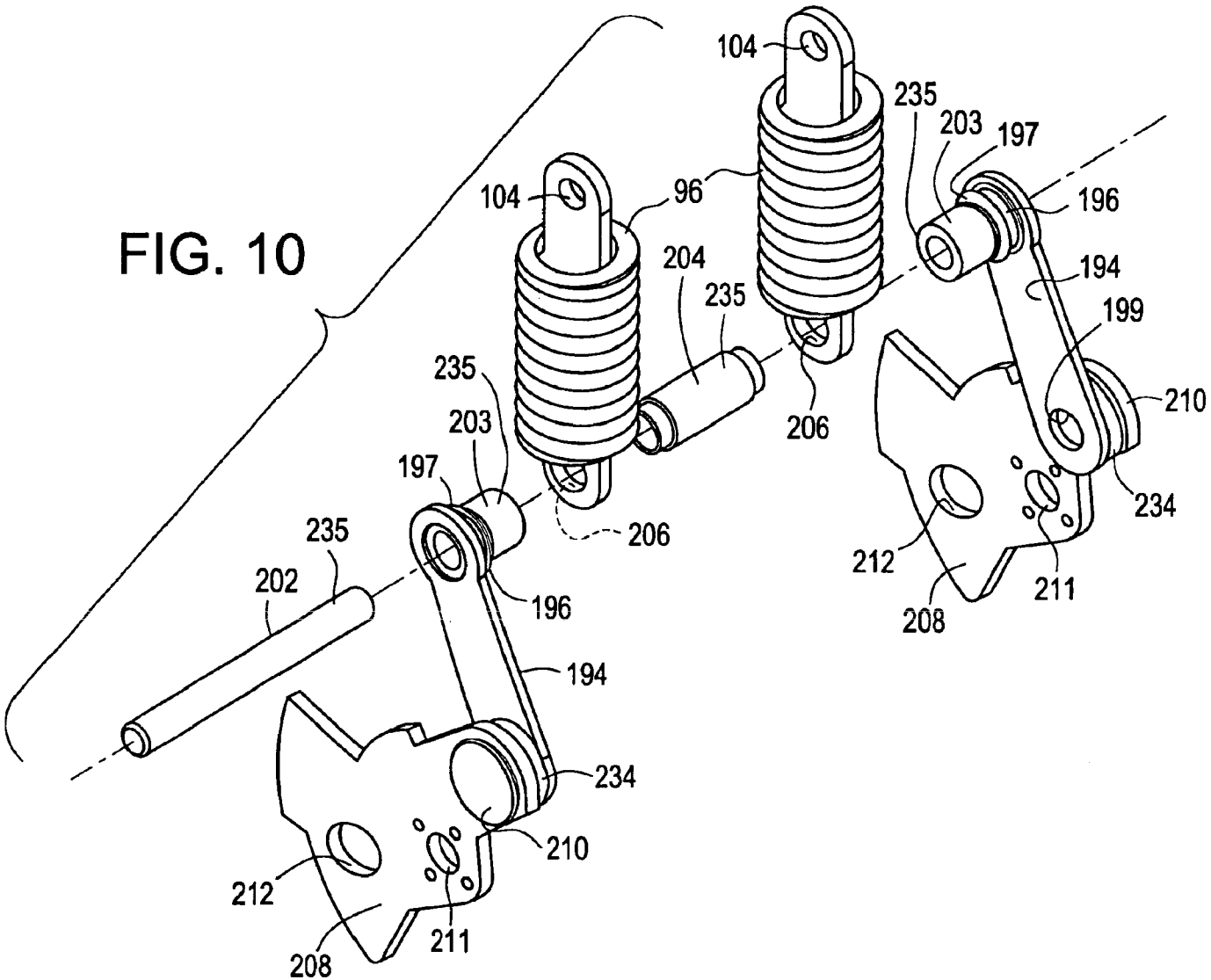
FIG. 10 is an exploded view of a pair of mechanism springs and associated linkage components within the operating mechanism.

Referring to FIG. 10, the bottom portion of mechanism springs 96 include a pair of openings 206. A drive connector 235 operative couples mechanism springs 96 to other operating mechanism components. Drive connector 235 comprises a pin 202 disposed through openings 206, a set of side tubes 203 arranged on pin 202 adjacent to the outside surface of the bottom portion of mechanism springs 96, and a central tube 204 arranged on pin 202 between the inside surfaces of the bottom portions of mechanism springs 96. Central tube 204 includes step portions at each end, generally configured to maintain a suitable distance between mechanism springs 96. While drive connector 235 is detailed herein as tubes 203, 204 and a pin 202, any means to connect the springs to the mechanism components are contemplated.

Figure 11A:
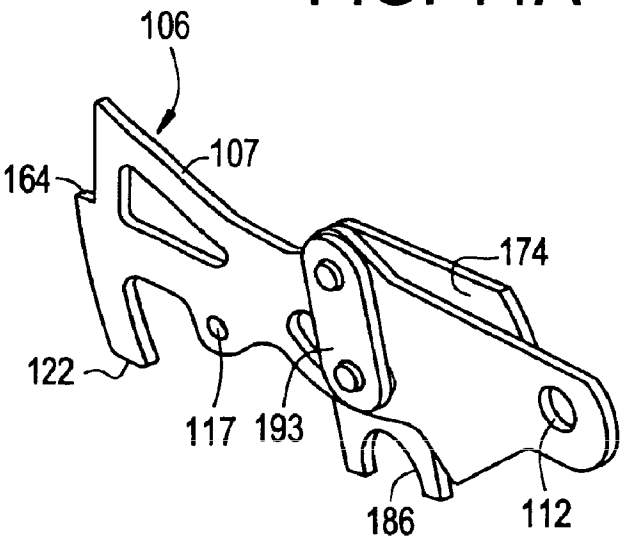
FIG. 11A is an isometric view of linkage components within the operating mechanism.
Figure 11B:
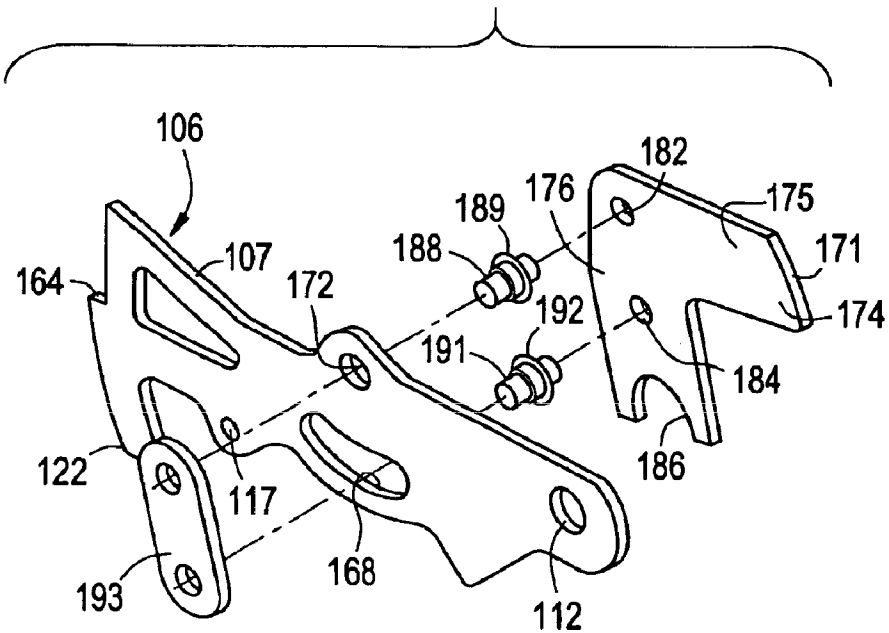
FIG. 11B is an exploded view of linkage components within the operating mechanism shown in FIG. 11A.

Referring to FIGS. 9 and 11, a pair of cradles 106 are disposed adjacent to side frames 86 and pivot on a pin 108 disposed through an opening 112 approximately at the end of each cradle 106. Each cradle 106 includes an edge surface 107, an arm 122 depending downwardly, and a cradle latch surface 164 above arm 122. Edge surface 107 is positioned generally at the portion of cradle 106 in the range of contact with roller pin 114. The movement of each cradle 106 is guided by a rivet 116 disposed through an arcuate passage 118 within each side frame 86. Rivets 116 are disposed within an opening 117 on each the cradle 106. An arcuate passage 168 is positioned intermediate to opening 112 and opening 117 on each cradle 106. An opening 172 is positioned above passage 168.

Referring back to FIGS. 7–9, a primary latch 126 is positioned within side frame 86. Primary latch 126 includes a pair of side portions 128. Each side portion 128 includes a bent leg 124 at the lower portion thereof. Side portions 128 are interconnected by a central portion 132. A set of extensions 166 depend outwardly from central portion 132 positioned to align with cradle latch surfaces 164.

Side portions 128 each include an opening 134 positioned so that primary latch 126 is rotatably disposed on a pin 136. Pin 136 is secured to each side frame 86. A set of upper side portions 156 are defined at the top end of side portions 128. Each upper side portion 156 has a primary latch surface 158.

A secondary latch 138 is pivotally straddled over side frames 86. Secondary latch 138 includes a set of pins 142 disposed in a complementary pair of notches 144 on each side frame 86. Secondary latch 138 includes a pair of secondary latch trip tabs 146 that extend perpendicularly from operating mechanism 38 as to allow an interface with, for example, an actuator (not shown), to release the engagement between primary latch 126 and secondary latch 138 thereby causing operating mechanism 38 to move to the "tripped" position (e.g., as in FIG. 6), described below. Secondary latch 138 includes a set of latch surfaces 162 that align with primary latch surfaces 158.

Secondary latch 138 is biased in the clockwise direction due to the pulling forces of a spring 148. Spring 148 has a first end connected at an opening 152 upon secondary latch 138, and a second end connected at a frame cross pin 154 disposed between frames 86.

Referring to FIGS. 9 and 11, a set of upper links 174 are connected to cradles 106. Upper links 174 generally have a right angle shape. Legs 175 (in a substantially horizontal configuration and FIGS. 9 and 11) of upper links 174 each have a cam portion 171 that interfaces a roller 173 disposed between frames 86. Legs 176 (in a substantially vertical configuration in FIGS. 9 and 11) of upper links 174 each have a pair of openings 182, 184 and a U-shaped portion 186 at the bottom end thereof. Opening 184 is intermediate to opening 182 and U-shaped portion 186. Upper links 174 connect to cradle 106 via a securement structure such as a rivet pin (rivet) 188 disposed through opening 172 and opening 182, and a securement structure such as a rivet pin (rivet) 191 disposed through passage 168 and opening 184. Rivet pins 188, 191 both attach to a connector 193 to secure each upper link 174 to each cradle 106. Each pin 188, 191 includes raised portions 189, 192, respectively. Raised portions 189, 192 are provided to maintain a space between each upper link 174 and each cradle 106. The space serves to reduce or eliminate friction between upper link 174 and cradle 106 during any operating mechanism motion, and also to spread force loading between cradles 106 and upper links 174.

Figure 12C:
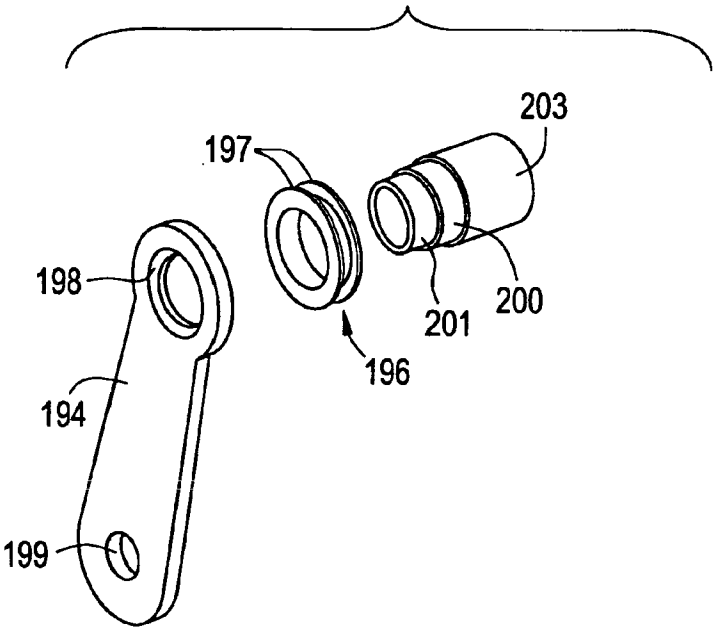
FIG. 12C is a partially exploded isometric view of the linkage component illustrated in FIG. 12B.
Figure 12B:
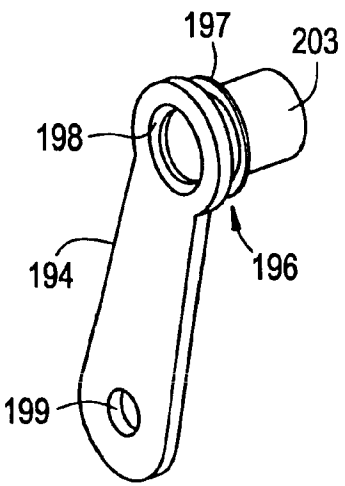
FIG. 12B is an isometric view of the linkage component illustrated in FIG. 12A.
Figure 12A:
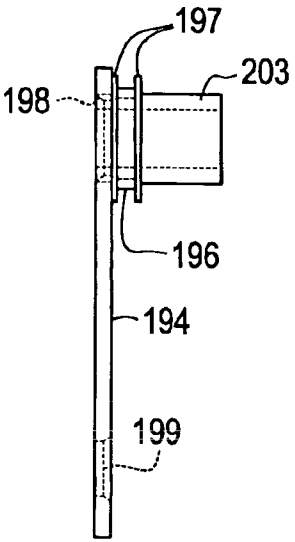
FIG. 12A is a front view of a linkage component within the operating mechanism.

Upper links 174 are each interconnected with a lower link 194. Referring now to FIGS. 9, 11 and 12, U-shaped portion 186 of each upper link 174 is disposed in a complementary set of bearing washers 196. Bearing washers 196 are arranged on each side tube 203 between a first step portion 200 of side tube 203 and an opening 198 at one end of lower link 194. Bearing washers 196 are configured to include side walls 197 spaced apart sufficiently so that U-shaped portions 186 of upper links 174 fit in bearing washer 196. Each side tube 203 is configured to have a second step portion 201. Each second step portion 201 is disposed through openings 198. Pin 202 is disposed through side tubes 203 and central tube 204. Pin 202 interfaces upper links 174 and lower links 194 via side tubes 203. Therefore, each side tube 203 is a common interface point for upper link 174 (as pivotally seated within side walls 197 of bearing washer 196), lower link 194 and mechanism springs 96.

Figure 13C:
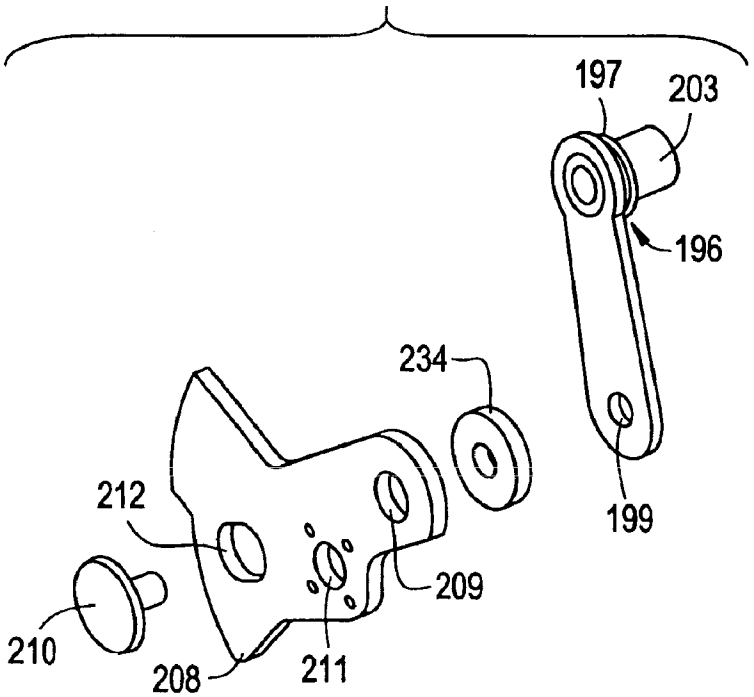
FIG. 13C is a partially exploded isometric view of the linkage components illustrated in FIG. 13B.
Figure 13B:
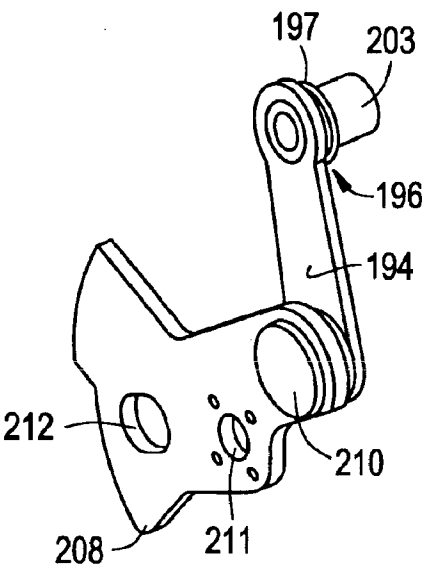
FIG. 13B is an isometric view of the linkage components illustrated in FIG. 13A.
Figure 13A:
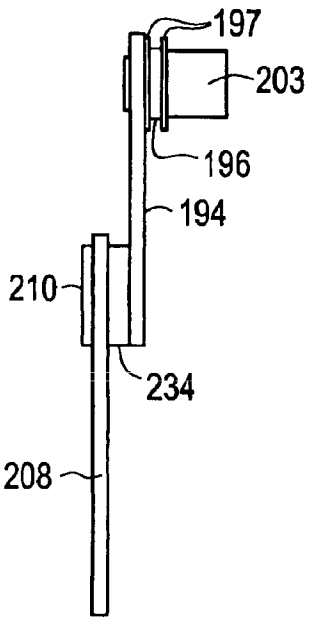
FIG. 13A is a front view of linkage components within the operating mechanism.

Referring to FIGS. 13A–13C, each lower link 194 is interconnected with a crank 208 via a pivotal rivet 210 disposed through an opening 199 in lower link 194 and an opening 209 in crank 208. Each crank 208 pivots about a center 78. Crank 208 has an opening 212 where cross pins 40, 41 (FIG. 2) pass through into arcuate passage 52 of cassettes 32, 34 and 36 (FIG. 2) and a complementary set of arcuate passages 214 on each side frame 86 (FIG. 9).

A spacer 234 is included on each pivotal rivet 210 between each lower link 194 and crank 208. Spacers 234 spread the force loading from lower links 194 to cranks 208 over a wider base, and also reduces friction between lower links 194 and cranks 208, thereby minimizing the likelihood of binding (e.g., when operating mechanism 38 is changed from the "off" position to the "on" position manually or mechanically, or when operating mechanism 38 is changed from the "on" position to the "tripped" position of the release of primary latch 126 and secondary latch 138).

Figure 14B:
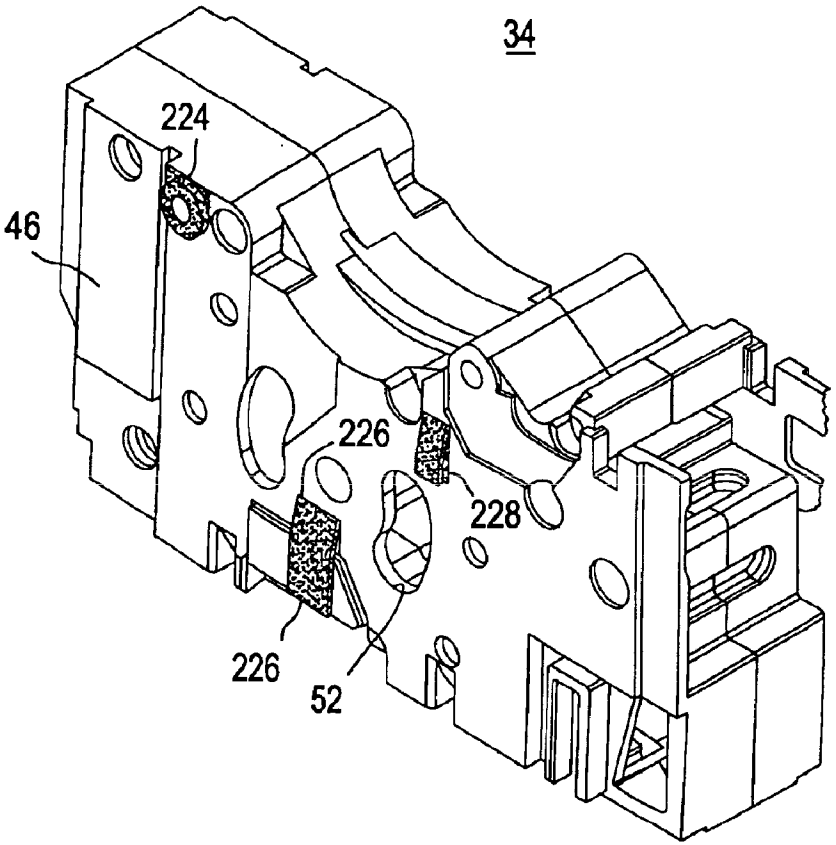
FIG. 14B depicts an isometric view of another side of a cassette employed within the circuit breaker.
Figure 14A:
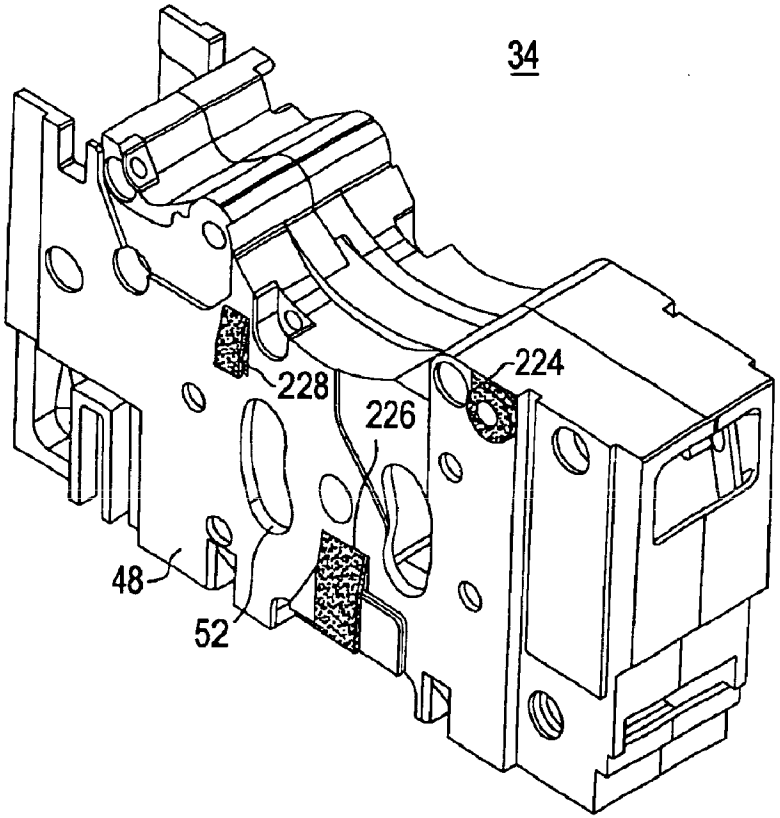
FIG. 14A depicts an isometric view of one side of a cassette employed within the circuit interrupter.

Referring to FIGS. 14A and 14B, views of both sidewalls 46 and 48 of cassette 34 are depicted. Sidewalls 46 and 48 include protrusions or bosses 224, 226 and 228 thereon. Bosses 224, 226 and 228 are attached to sidewalls 46, 48, or can be molded features on sidewalls 46, 48. Note that cassette 34 is depicted and certain features are described herein because operating mechanism 38 straddles cassette 34, i.e., the central cassette, in circuit breaker 10. It is contemplated that the features may be incorporated in cassettes in other positions, and with or without operating mechanism 38 included thereon, for example, if it is beneficial from a manufacturing standpoint to include the features on all cassettes.

Figure 15:
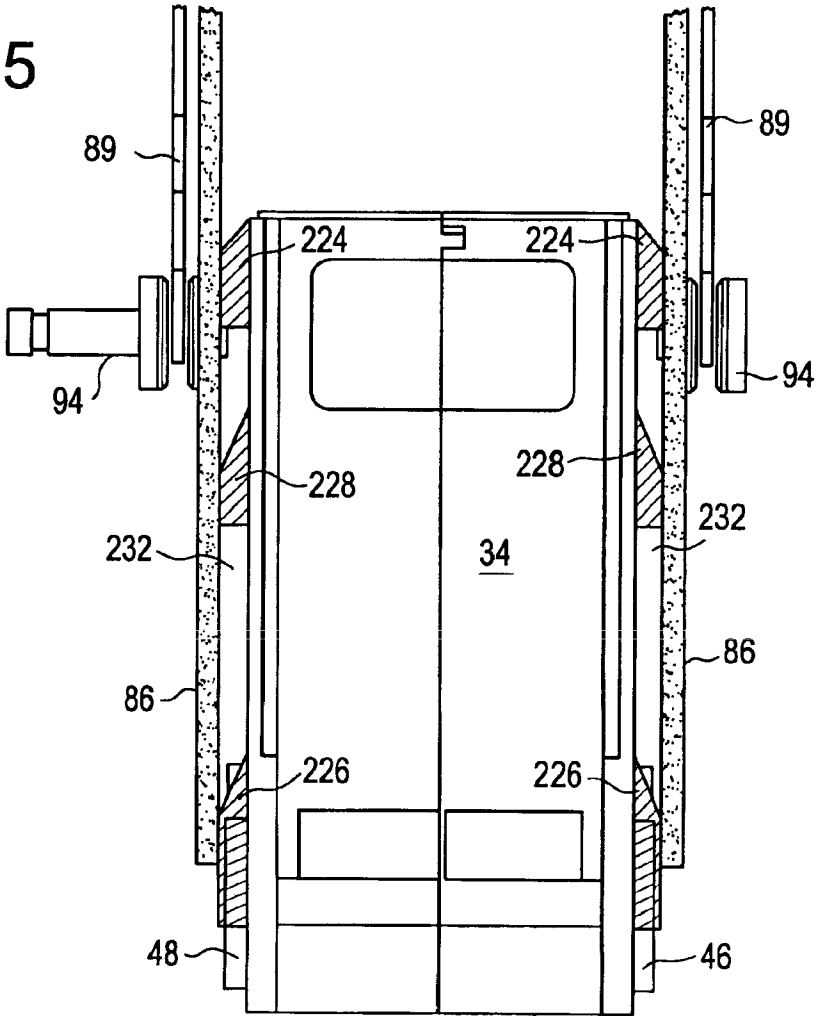
FIG. 15 is a front view of the cassette and the operating mechanism positioned thereon.
Figure 16:
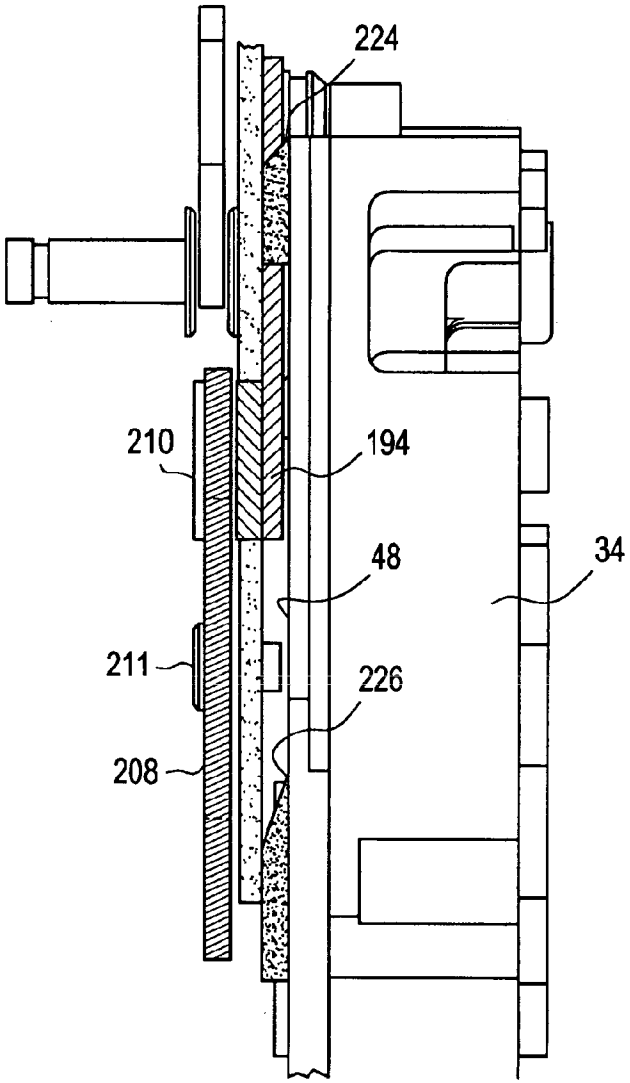
FIG. 16 is a partial front view of the cassette and the operating mechanism positioned thereon.

Referring now to FIG. 15, side frames 86 of operating mechanism 38 are positioned over sidewall 46, 48 of cassette 34. Portions of the inside surfaces of side frames 86 contact bosses 224, 226 and 228, creating a space 232 between each sidewall 46, 48 and each side frame 86. Referring now also to FIG. 15, space 232 allows lower links 194 to properly transmit motion to cranks 208 without binding or hindrance due to frictional interference from sidewalls 46, 48 or side frames 86.

Additionally, the provision of bosses 224, 226 and 228 widens the base of operating mechanism 38, allowing for force to be transmitted with increased stability. Accordingly, bosses 224, 226 and 228 should be dimensioned sufficiently large to allow clearance of links 194 without interfering with adjacent cassettes such as cassettes 32 and 36.

Referring back to FIGS. 4–6, the movement of operating mechanism 38 relative to rotary contact assembly 56 will be detailed.

Referring to FIG. 4, in the "off" position toggle handle 44 is rotated to the left and mechanism springs 96, lower link 194 and crank 208 are positioned to maintain contact arm 68 so that movable contacts 72, 74 remain separated from stationary contacts 64, 66. Operating mechanism 38 becomes set in the "off" position after a reset force properly aligns primary latch 126, secondary latch 138 and cradle 106 (e.g., after operating mechanism 38 has been tripped) and is released. Thus, when the reset force is released, extensions 166 of primary latch 126 rest upon cradle latch surfaces 164, and primary latch surfaces 158 rest upon secondary latch surfaces 162. Each upper link 174 and lower link 194 are bent with respect to each side tube 203. The line of forces generated by mechanism springs 96 (i.e., between spring anchor 98 and pin 202) is to the left of bearing portion 94 (as oriented in FIGS. 4–6). Cam surface 171 of upper link 174 is out of contact with roller 173.

Referring now to FIG. 5, a manual closing force was applied to toggle handle 44 to move it from the "off" position (i.e., FIG. 4) to the "on" position (i.e., to the right as oriented in FIG. 5). While the closing force is applied, upper links 174 rotate within arcuate passages 168 of cradles 106 about pins 188, and lower link 194 is driven to the right under bias of the mechanism spring 96. Raised portions 189 and 192 (FIG. 11B) maintain a suitable space between the surfaces of upper links 174 and cradles 106 to prevent friction therebetween, which would increase the required set operating mechanism 38 from "off" to "on". Furthermore, side walls 197 of bearing washers 196 (FIG. 12C) maintain the position of upper link 174 on side tube 203 and minimize likelihood of binding (e.g., so as to prevent upper link 174 from shifting into springs 96 or into lower link 194).

To align vertical leg 176 and lower link 194, the line of force generated by mechanism springs 96 is shifted to the right of bearing portion 94, which causes rivet 210 coupling lower link 194 and crank 208 to be driven downwardly and to rotate crank 208 clockwise about center 78. This, in turn, drives cross pin 40 to the upper end of arcuate passage 214. Therefore, the forces transmitted through cross pin 40 to rotary contact assembly 56 via opening 82 drive movable contacts 72, 74 into stationary contacts 64, 66. Each spacer 234 on pivotal rivet 210 (FIGS. 10 and 13) maintain the appropriate distance between lower links 194 and cranks 208 to prevent interference or friction therebetween or from side frames 86.

The interface between primary latch 126 and secondary latch 138 (i.e., between primary latch surface 158 and secondary latch surface 162), and between cradles 106 and primary latch 126 (i.e., between extensions 166 and cradle latch surfaces 164) is not affected when a force is applied to toggle handle 44 to change from the "off" position to the "on" position.

Referring now to FIG. 6, in the "tripped" condition, secondary latch trip tab 146 has been displaced (e.g., by an actuator, not shown), and the interface between primary latch 126 and secondary latch 138 is released. Extensions 166 of primary latch 126 are disengaged from cradle latch surfaces 164, and cradles 106 is rotated clockwise about pin 108 (i.e., motion guided by rivet 116 in arcuate passage 118). The movement of cradle 106 transmits a force via rivets 188, 191 to upper link 174 (having cam surface 171). After a short predetermined rotation, cam surface 171 of upper link 174 contacts roller 173. The force resulting from the contact of cam surface 171 on roller 173 causes upper link 174 and lower link 194 to buckle and allows mechanism springs 96 to pull lower link 194 via pin 202. In turn, lower link 194 transmits a force to crank 208 (i.e., via rivet 210), causing crank 208 to rotate counter clockwise about center 78 and drive cross pin 40 to the lower portion of arcuate passage 214. The forces transmitted through cross pin 40 to rotary contact assembly 56 via opening 82 cause movable contacts 72, 74 to separate from stationary contacts 64, 66.

Figure 17:
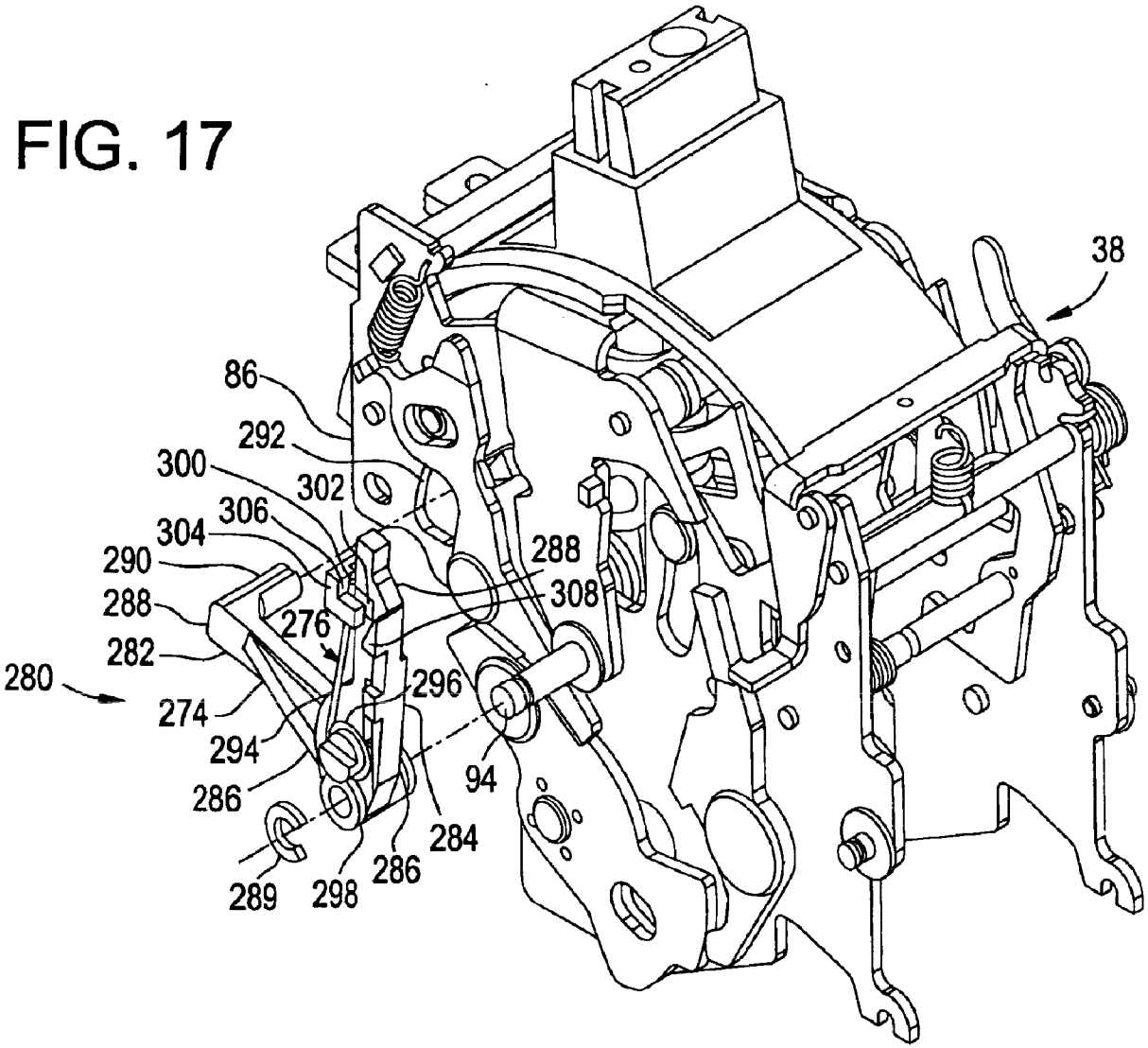
FIG. 17 is a side perspective view of the mounting of the positioning lever with the operating mechanism and the side frame.

Referring to FIG. 17, a mechanical bell alarm assembly 272 (FIG. 19) will now be detailed. The mechanical bell alarm assembly 272 comprises a positioning lever (lever) 274 in mechanical cooperation with the actuator 42 (FIG. 19) via a compliant member 276. The compliant member 276 is preferably a torsional spring although any similar means may be employed such as a leaf spring and a compression spring. In this way, a compliant device 280 comprises the lever 274 and the compliant member 276.

The positioning lever 274 is shown rotatably mounted to the bearing portion (pivot) 94 of the operating mechanism 38. Positioning lever 274 includes a first leg 282 and a second leg 284 where the first leg 282 and the second leg 284 extend from the pivot 94. The first leg 282 and second leg 284 each include an end 286 proximate to the pivot 94 and free ends 288, 289, respectively opposing the pivot 94. The lever 274 is permitted rotation about the pivot 94 and is held in place preferably by a retaining ring 289, although any similar fastening means may be employed. The first leg 282 of the lever 274 includes an arm 290 extending generally perpendicularly therefrom, preferably proximate to the free end 288. The arm 290 extends through an opening 292 located within the sideframe 86 of the operating mechanism 38. The compliant member 276 has a leg portion 294 that extends from the end 286 to the free end 289 of the second leg 284. A fixed end 296 of the compliant member 276 is slidingly inserted into a correspondingly shaped recess 298 located within the second leg 284. A second movable end 300 of the compliant member 276 is forcibly held in tension within a passage 302 formed by an L-shaped arm 304 extending from the free end 289 of the second leg 284. The second movable end 300 of the compliant member 276 contacts an inner surface 306 of the arm 304. Adjacent to the passage 302 is a tab 308 that guides the leg portion 294 into the passage 302. As shown in FIG. 17, the leg portion 294 is aligned with the second leg 284 of the lever 274.

Figure 18:
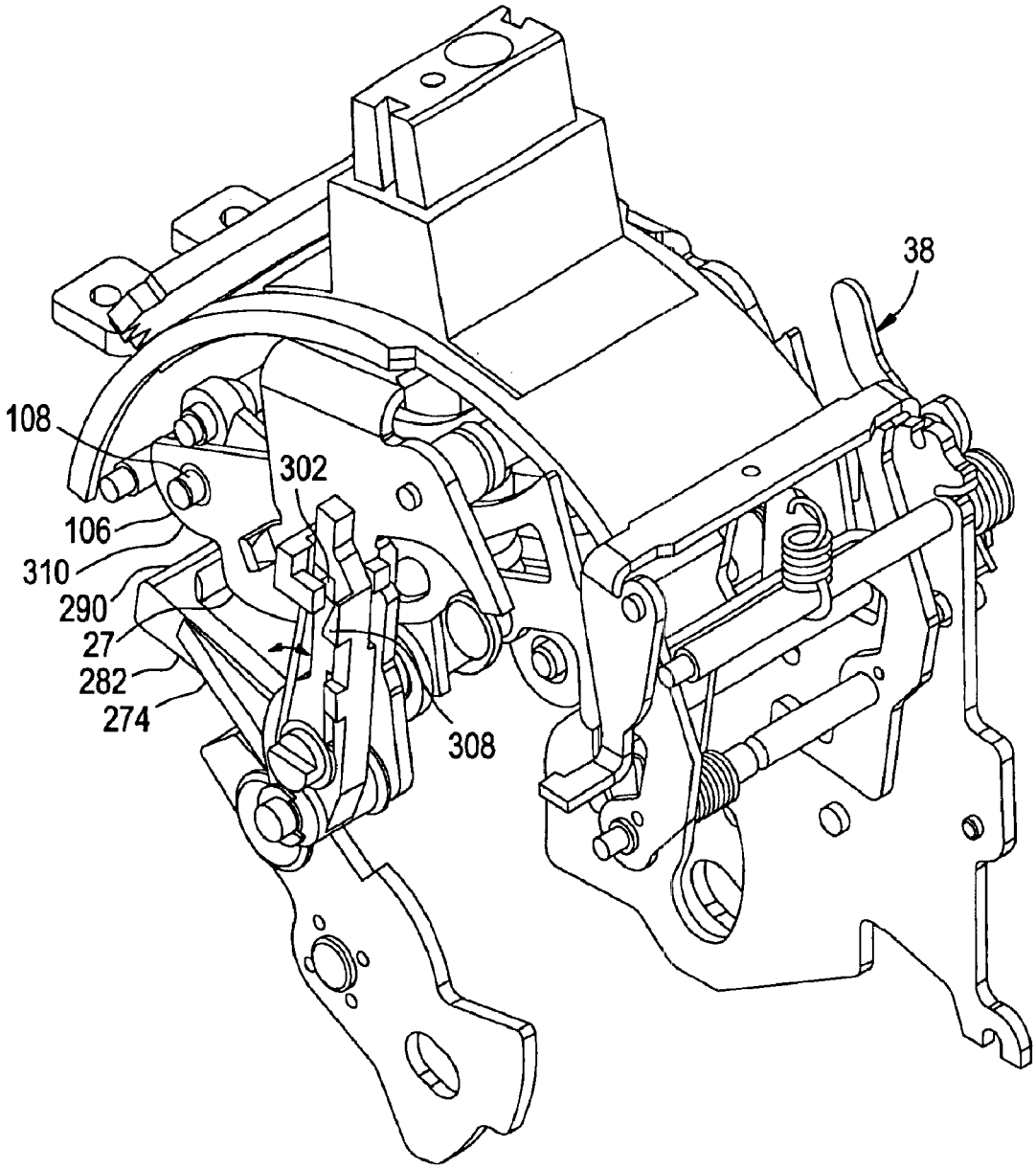
FIG. 18 is a side perspective view of the positioning bar and the cradle of the operating mechanism with the side frame removed.

Referring to FIG. 18, the lever is shown in relation to the cradle 106 of the operating mechanism 38 with the side frame 86 (FIG. 2) removed. Once the arm 290 of the first leg 282 of the lever 274 is inserted through the opening 292 in the side frame 86 as shown in FIG. 17, the arm 290 is positioned to engage a surface 310 of the cradle 106 which will be detailed hereinafter when the operation of the bell alarm assembly 272 (FIG. 19) is detailed.

Figure 19:
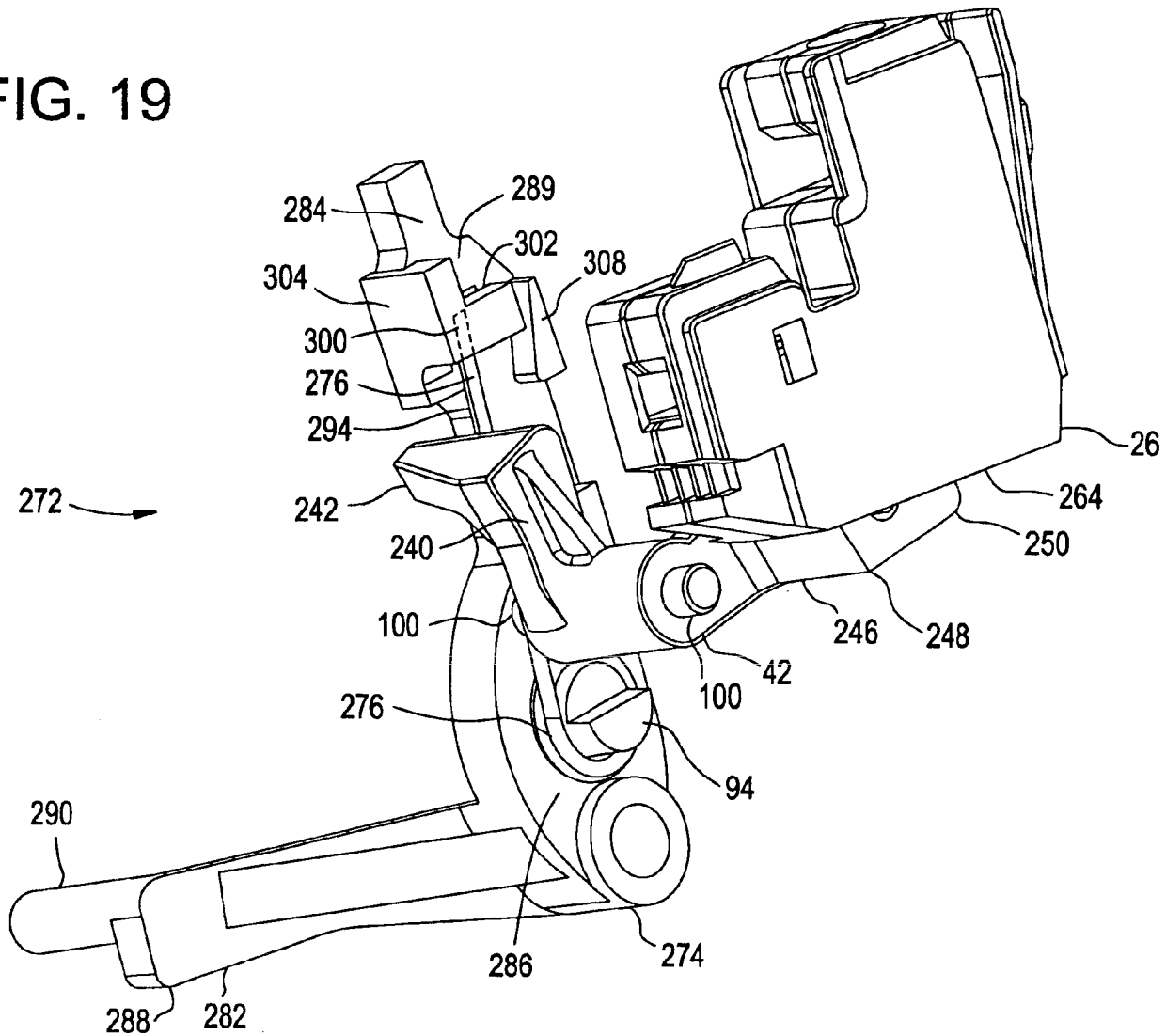
FIG. 19 is a perspective view of the mechanical bell alarm assembly including the positioning bar, the actuator and the bell alarm switch, where the assembly is in the activated position.
Figure 20:
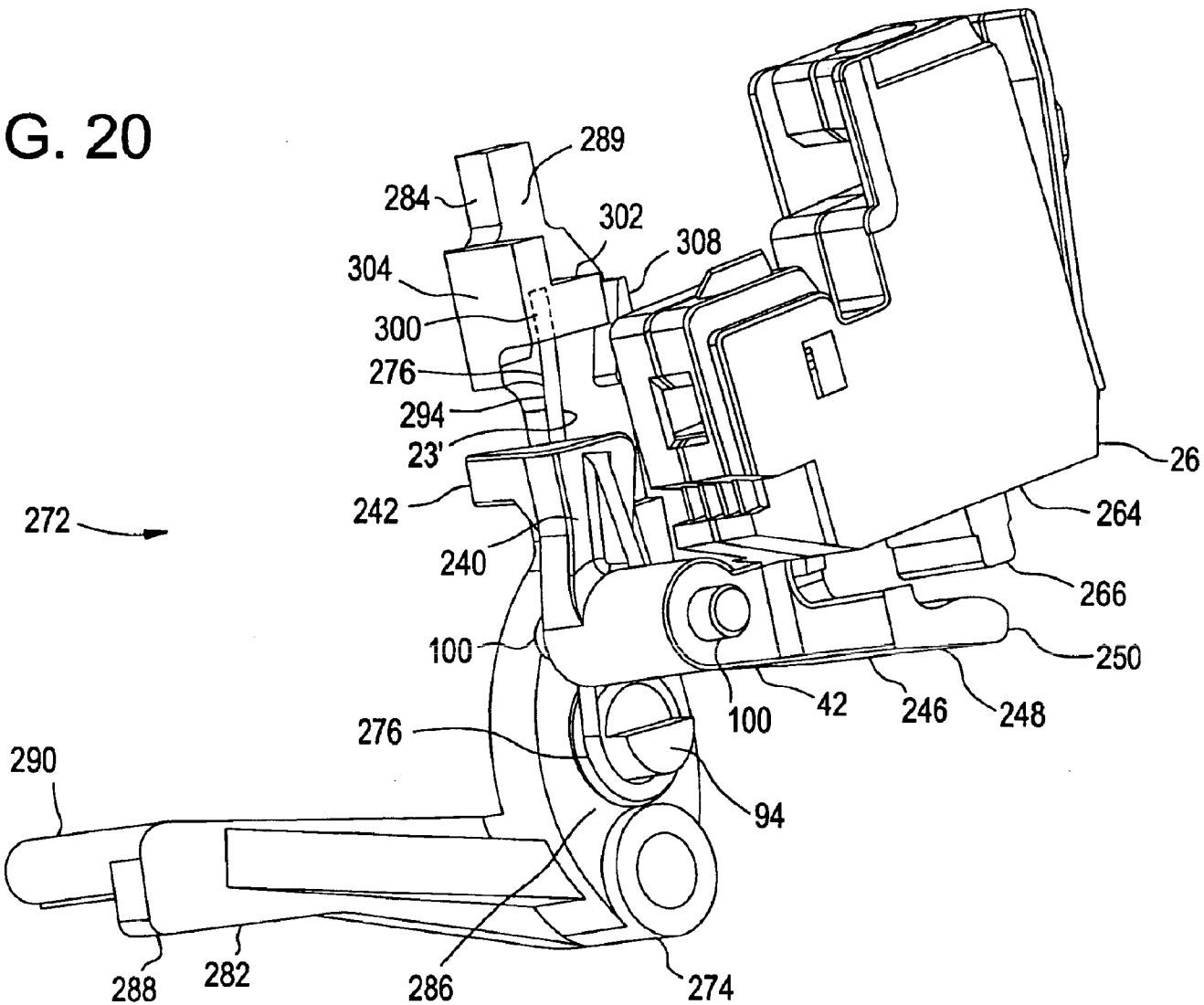
FIG. 20 is a perspective view of the assembly of FIG. 19 where the assembly in the unactivated position.

Referring to FIGS. 19 and 20 the assembly 272 of the lever 274, the bell alarm switch 26 and the actuator 42 is shown in the activated position and the unactivated position, respectively. The first leg 240 of the actuator 42 is positioned proximate to the leg portion 294. The second leg 246, and in particular, the finger 250 is located proximate to the plunger 266. The interaction between the operating mechanism 38 (FIG. 2), lever 274, compliant member 276, actuator 42 and switch 26 will be detailed hereinafter.

The clockwise rotation of cradle 106 as to reset the assembly after a trip (described further herein) will accordingly transmit motion simultaneously through the lever 274, actuator 42 and switch 26. The lever 274 rotates counterclockwise about pivot 94 thereby urging the leg portion 294 to forcibly engage the first leg 240 of the actuator 42. The actuator 42 rotates counterclockwise about tabs 100 which are mounted in the cavity 50 (FIG. 3), as described hereinabove with reference to FIG. 3, thereby causing the finger 250 of the actuator 42 to forcible engage and retract the plunger 266 of the switch 26.

Referring to FIGS. 19–22, the operation and movement of the mechanical bell alarm assembly 272 as utilized with the operating mechanism 38 will now be detailed. The mechanical bell alarm assembly (assembly) 272 is employed to provide indication when the operating mechanism 38 is discharged as is the case when the circuit breaker 10 (FIG. 1) is in the tripped condition.

Figure 21:
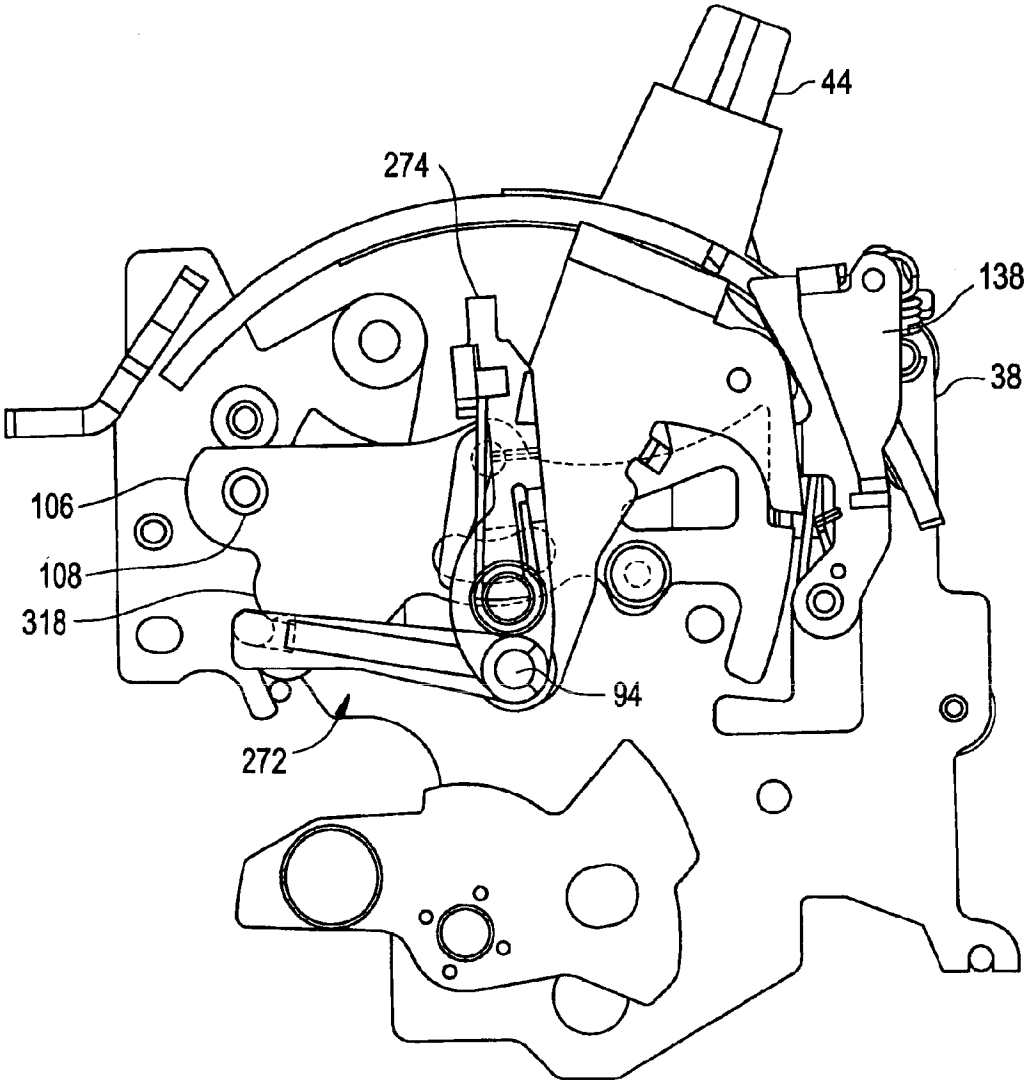
FIG. 21 is a side view of the operating mechanism in the latched position and the positioning bar in the activated position.
Figure 22:
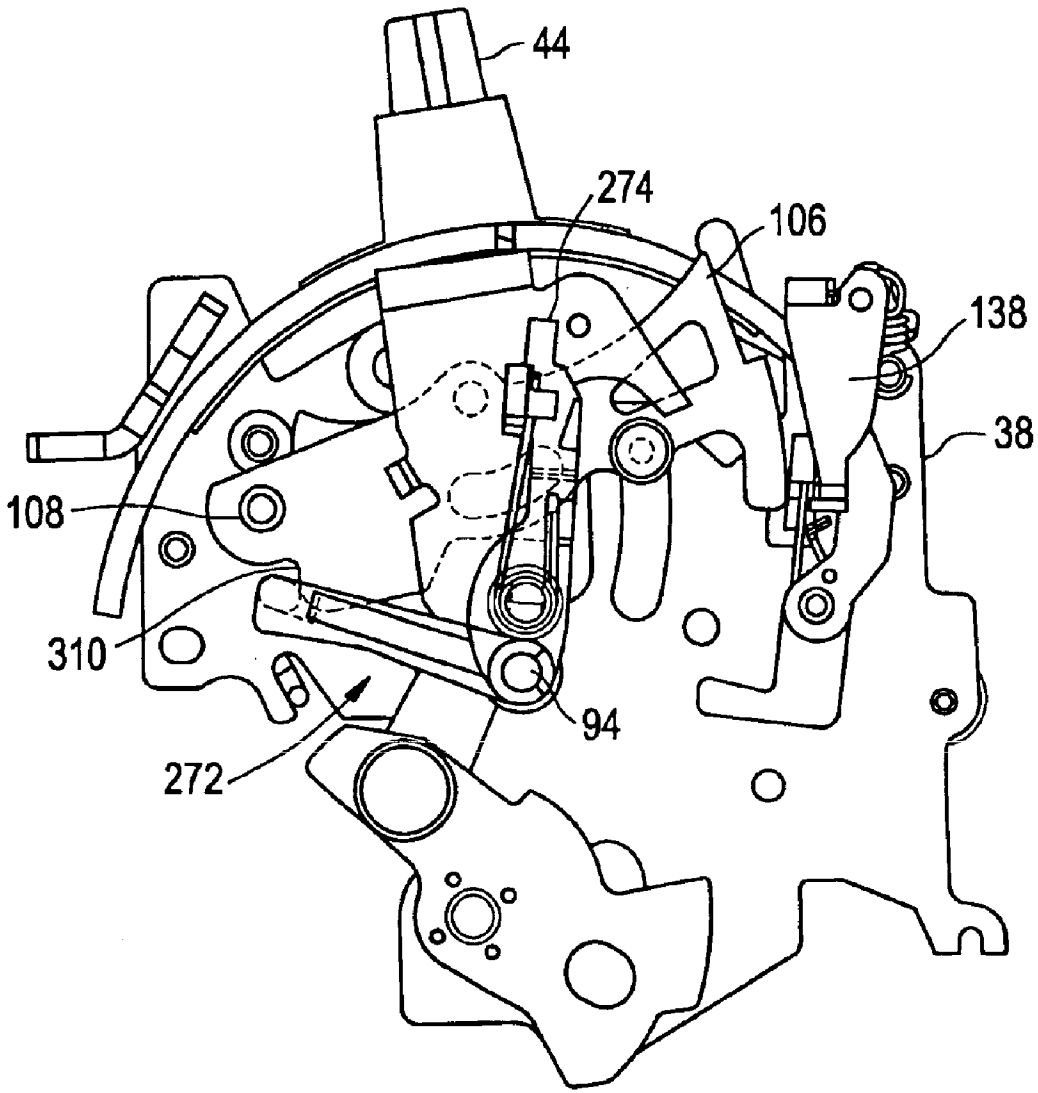
FIG. 22 is a side view of the operating mechanism in the unlatched position and the positioning bar in the unactivated position.

FIGS. 19 and 21 show the assembly 272 when in the activated position. The activated position is when the circuit breaker 10 (FIG. 1) is in the latched position (charged). The circuit breaker 10 is charged when the operating mechanism 38 is as shown in FIGS. 4 and 5. FIGS. 20 and 22 show the assembly 272 and the operating mechanism 38 when in the inactivated position such as when a trip condition occurs. The circuit breaker 10 is discharged when the operating mechanism 38 is as shown in FIG. 6. From the description of the operating mechanism 38 as detailed hereinabove with reference to FIGS. 4–6, the cradle 106 remains in the position as shown in FIGS. 4 and 5. Thus, the bell alarm assembly 272 remains in the activated position until the circuit breaker 10 is in the unlatched position (discharged).

Thus, when the circuit breaker 10 is "ON", the plunger 266 on the switch 26 is latched such that the surface 310 of the cradle 106 is in contact with the arm 290 of the lever 274. Also, the leg portion 294 is in contact with, and applying a counterclockwise torque, about the pivot 94 against the clockwise torque applied about the tabs 100 by the force of the spring loaded plunger 266 applied against the actuator 42. Further, the finger 250 of the actuator 42 is pressingly engaged against the plunger 266 of the switch 26 such that the plunger 266 is fully depressed and the contacts within the switch 26 are closed. This is the condition of quiescent operation of the circuit breaker 10, wherein the cradle 106 is engaged with the lever 274, the lever 274, via the leg portion 294, is engaged with the actuator 42, and the finger 250 of the actuator 42 fully engages the plunger 266 of the switch 26 maintaining the plunger 266 in a loaded or retracted position. The assembly 272 is in the "activated" position.

When the circuit breaker 10 is tripped, for example due to an overcurrent condition or a mechanical trip, toggle handle 44 is between the "ON" position and the "OFF" position. Upon the occurrence of such an overcurrent condition and simultaneous articulation of the operating mechanism 38 to separate the contacts, the assembly 272 is inactivated consistent with the circuit breaker 10 being in the uncharged state. When the assembly 272 is in the unactivated position, there is a gap between the surface 310 of the cradle 106 and the arm 290 of the lever 274, a gap between the leg portion 294 and the first leg 240 of the actuator 42 and additionally, there is a gap between the finger 250 of the actuator 42 and the plunger 266. Although there may be such gaps, when the assembly 272 is in the unactivated position, there is no load on the assembly 272 as there is when it is in the activated position. The inactivation of the switch 26 whereby the plunger 266 is released to a protruded position, as shown in FIG. 20, provides an indication to a remote operator, for example, that such a tripped condition has occurred and that the operating mechanism 38 has responded to interrupt the circuit current.

In order to reengage the operating mechanism 38 to the "ON" position, so as to return to quiescent condition, both operating mechanism 38 and assembly 272, or more particularly, the switch 26 must be reset.

Before toggle handle 44 may be returned to the quiescent operation position, i.e., "ON", circuit breaker operating mechanism 38 must be reset. This is accomplished by manually rotating toggle handle 44 in the counter-clockwise direction against the forces of one or more springs 96 (FIG. 4), thereby resetting latch 138 of operating mechanism 38 from the "Tripped" position to the "Latched" position.

It is understood that the assembly 272 remains in the activated position until the operating mechanism 38 is discharged. The movement of the operating mechanism 38 from the discharged position (tripped position) to the charged position and the movement of the assembly 272 from the unactivated position to the activated position will now be described with reference to FIGS. 19–22.

When it is desired to charge the operating mechanism 38, the cradle 106 is rotated clockwise about pivot 108, for example, by a motor control unit, manual operation of the toggle handle 44 or remote operating device. The surface 310 of the cradle 106 then contacts the arm 290 of the first leg 282 of the lever 274. The lever 274 rotates counter-clockwise about pivot 94. The rotation of the lever 274 urges the second leg 284, and more particularly the leg portion 294 of the compliant member 276, to engage the first leg 240 of the actuator 42. The leg portion 294 pushes against the first leg 240 of the actuator 42 causing the actuator 42 to rotate counterclockwise about the tabs 100. This in turn causes the second leg 246 of the actuator 42, and more particularly, the finger 250 to engage the plunger 266 of the switch 26. The plunger 266 is pushed inward such that the plunger 266 is flush against the bottom surface 264 of the switch 26 thus activating the contacts within the switch 26 placing the switch 26 in the activated position.

The compliant member 276, and in particular the leg portion 294, is employed to provide mechanical cooperation between the interfaced members, (the lever 274 and the actuator 42), while adding compliancy to absorb forces in excess of those required to reset the switch 26.

It is noted that the counterclockwise torque applied by the lever 274 and compliant member 276 about the pivot 94 onto the actuator 42 must be greater, preferably about one and a half times greater, than the clockwise torque applied by the plunger 266 and the actuator 42 about the tabs 100. This ensures that the plunger 266 is fully depressed by the finger 250 of the actuator 42 when the lever 274 is rotated about pivot 94 to activate the assembly 272. Since the second movable end 300 of the compliant member 276 is forcibly positioned within the passage 302 of the arm 304, the compliant member 276 will compensate or absorb any excessive rotational force. Any excess rotational force (reset force) applied by the cradle 106 of the operating mechanism 38 to the lever 274, via the leg portion 294 and the actuator 42, is compensated for by the ability of the second movable end 300 of the compliant member 276 to deflect from the inner surface 306 (FIG. 17) of the arm 304 of the first leg 284 of the lever 274. This ensures that the finger 250 of the actuator 42 applies the proper amount of force against the plunger 266 to fully depress the plunger 266. Thus, the finger 250 will not apply excessive force against the bottom surface 264 of the switch 26. Although the compliant member 276 in permitted rotational movement within the passage 302 as shown by the arrows in FIG. 18, the compliant member 276 will be prevented from being disengaged from the lever 274 by the tab 308.

Thus, a compact mechanical bell alarm assembly 272 is provided which is easily assembled and is contained within the space available within the mid cover 20. Also, the end user can easily utilize the mechanical bell alarm assembly 272 with the bell alarm switch 26 that is easily engaged within the mid cover 20. Additionally, any manufacturing variances as to the precise location of the assembly 272 within mid cover 20 and relative to the cradle 106 of the operating mechanism 38 are tolerated, as are field or installation imperfections that may jolt or otherwise shift the locations of the assembly relative to the cradle 106. The ability to compensate for manufacturing tolerances ensures that the bell alarm switch 26 provides accurate status indications of the operating mechanism 38 through the assembly 272.

While the invention has been described with reference to a preferred embodiment, it will be understood by those skilled in the art that various changes may be made and equivalents may be substituted for elements thereof without departing from the scope of invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An assembly for interacting with an operating mechanism of a circuit breaker, the circuit breaker including a housing and a pair of contacts within the housing, the operating mechanism arranged to separate the pair of contacts upon the occurrence of a trip event, the assembly comprising:

an accessory device disposed in the housing including a plunger receptive to movement between a retracted position and a protruded position dependent on movement of the operating mechanism;

an actuator having a first free end and a second free end, said second free end of said actuator configured for mechanical cooperation with said plunger;

a compliant device disposed intermediate the operating mechanism and said actuator, said compliant device configured for mechanical cooperation with said first free end of said actuator; and a force being applied from the operating mechanism to said accessory device, the force resetting said accessory device by being transmitted from the operating mechanism to said compliant device, from said compliant device to said actuator, and from said actuator to said plunger for resetting said plunger from said protruded position to said retracted position.

2. The assembly of claim 1, wherein said accessory device is a bell alarm.

3. The assembly of claim 1 wherein said compliant device includes:

a lever rotatable about a pivot, said lever having a first free end and a second free end, said first free end configured for interacting with the operating mechanism; and a compliant member having a fixed end and a movable end, said fixed end attached to said lever.

4. The assembly of claim 3 wherein said compliant member is selected from the group consisting of torsional springs, leaf springs, and compression springs.

5. The assembly of claim 1 wherein said actuator includes a main body portion having a first tab and an opposing second tab, a first leg extending from said main body portion and including said first free end and a second leg extending from said main body portion and including said second free end;

wherein said first tab and said second tab are rotatingly mounted within the housing, said lever rotates in response to unlatching of the operating mechanism thereby urging said compliant member to engage said first leg of said actuator, said actuator rotates about said first and second tabs thereby urging said second leg of said actuator to engage said plunger when the operating mechanism is latched.

6. The assembly of claim 5 wherein said second leg of said actuator includes a finger extending from said second free end of said actuator, said finger engages said plunger when the operating mechanism is latched.

7. The assembly of claim 3 wherein said lever includes a first leg and a second leg extending from said pivot of said lever, said first leg including an arm extending therefrom and said second leg including an arm, said arm forms a passage at said second free end;

wherein said movable end of said compliant member resiliently traverses said passage.

8. The assembly of claim 7, wherein said compliant member is a spring, said fixed end of said compliant member operatively connects to said lever and said movable end captured within said passage of said lever;

wherein said spring pushes against said first leg of said actuator when the operating mechanism is in a latched position thereby urging said plunger in said retracted position and releases said second leg of said actuator when the operating mechanism is in an unlatched position thereby urging said plunger in said protruded position.

9. A circuit breaker comprising:

a housing;

a pair of electrical contacts within said housing;

an operating mechanism arranged to separate said pair of electrical contacts;

an accessory device disposed in said housing including a plunger receptive to movement between a retracted position and a protruded position dependent on movement of said operating mechanism;

an actuator having a first free end and a second free end, said second free end of said actuator configured for mechanical cooperation with said plunger;

a compliant device disposed intermediate the operating mechanism and said actuator, said compliant device configured for mechanical cooperation with said first free end of said actuator; and a force being applied from the operating mechanism to said accessory device, the force resetting said accessory device by being transmitted from said operating mechanism to said compliant device, from said compliant device to said actuator, and from said actuator to said plunger for resetting said plunger from said protruded position to said retracted position.

10. The circuit breaker of claim 9, wherein said accessory device is a bell alarm.

11. The circuit breaker of claim 9 wherein said compliant device includes:

a lever rotatable about a pivot, said lever having a first free end and a second free end, said first free end configured for interacting with the operating mechanism; and a compliant member having a fixed end and a movable end, said fixed end attached to said lever.

12. The circuit breaker of claim 11 wherein said compliant member is selected from the group consisting of torsional springs, leaf springs, and compression springs.

13. The circuit breaker of claim 9 wherein said actuator includes a main body portion having a first tab and an opposing second tab, a first leg extending from said main body portion and including said first free end and a second leg extending from said main body portion and including said second free end;

wherein said first tab and said second tab are rotatingly mounted within said housing, said lever rotates in response to unlatching of said operating mechanism thereby urging said compliant member to engage said first leg of said actuator, said actuator rotates about said first and second tabs thereby urging said second leg of said actuator to engage said plunger when said operating mechanism is latched.

14. The circuit breaker of claim 13 wherein said second leg of said actuator includes a finger extending from said second free end, said finger engages said plunger when said operating mechanism is latched.

15. The circuit breaker of claim 11 wherein said lever includes a first leg and a second leg extending from said pivot of said lever, said first leg including an arm extending therefrom and said second leg including an arm forming a passage at said second free end of said lever;

wherein said movable end of said compliant member resiliently traverses said passage.

16. The circuit breaker of claim 15, wherein said compliant member is a spring, said fixed end of said compliant member operatively connects to said lever and said movable end captured within said passage of said lever;

wherein said spring pushes against said first leg of said actuator when said operating mechanism is in a latched position thereby urging said plunger in said retracted position and releases said second leg of said actuator when said operating mechanism is in an unlatched position thereby urging said plunger in said protruded position.

17. An assembly for interacting with an operating mechanism of a circuit breaker, the circuit breaker including a housing and a pair of contacts within the housing, the operating mechanism arranged to separate the pair of contacts upon the occurrence of a trip event, the assembly comprising:

an accessory device disposed in the housing including a plunger receptive to configured for movement between a retracted position and a protruded position dependent on movement of the operating mechanism;

an actuator having a first free end and a second free end, said second free end of said actuator configured for mechanical cooperation with said plunger, said actuator having a compliant means disposed intermediate the operating mechanism and said actuator, said compliant means for mechanical cooperation with said second free end of said actuator; and a force being applied from the operating mechanism to said accessory device, the force for resetting said accessory device by being transmitted from the operating mechanism to said compliant means, from said compliant means to said actuator, and from said actuator to said plunger for resetting said plunger from said protruded position to said retracted position.

18. An assembly for interacting with an operating mechanism of a circuit breaker, the circuit breaker including a housing and a pair of contacts within the housing, the operating mechanism arranged to separate the pair of contacts upon the occurrence of a trip event, the assembly comprising:

an accessory device disposed in the housing said device including a plunger receptive to movement between a retracted position and a protruded position dependent on movement of the operating mechanism;

an actuator having a first free and a second free end, said second free end of said actuator configured for mechanical cooperation with said plunger; and a compliant device disposed intermediate the operating mechanism and said actuator, said compliant device configured for mechanical cooperation with said first free end of said actuator;

wherein said accessory device is receptive to a force applied by the operating mechanism to reset said accessory device, the operating mechanism transmitting the force to said compliant device, from said compliant device to said actuator, and from said actuator to said plunger for resetting said plunger from said protruded position to said retracted position.

* * * * *